US009139887B2

(12) United States Patent
Honjo et al.

(10) Patent No.: US 9,139,887 B2
(45) Date of Patent: Sep. 22, 2015

(54) BEARING STEEL AND INGOT MATERIAL FOR BEARING HAVING EXCELLENT ROLLING CONTACT FATIGUE LIFE CHARACTERISTICS AND METHOD FOR MANUFACTURING THE SAME

(75) Inventors: Minoru Honjo, Tokyo (JP); Kazukuni Hase, Tokyo (JP); Tatsumi Kimura, Tokyo (JP); Shinji Mitao, Tokyo (JP)

(73) Assignees: JFE STEEL CORPORATION, Tokyo (JP); NTN CORPORATION, Osaka (JP)

( * ) Notice: Subject to any disclaimer, the term of this patent is extended or adjusted under 35 U.S.C. 154(b) by 0 days.

(21) Appl. No.: 13/819,920

(22) PCT Filed: May 24, 2011

(86) PCT No.: PCT/JP2011/002886

§ 371 (c)(1), (2), (4) Date: Mar. 15, 2013

(87) PCT Pub. No.: WO2012/029212

PCT Pub. Date: Mar. 8, 2012

(65) Prior Publication Data

US 2013/0174945 A1 Jul. 11, 2013

(30) Foreign Application Priority Data

Aug. 31, 2010 (JP) ..... 2010-194919
Apr. 26, 2011 (JP) ..... 2011-098664

(51) Int. Cl.

*C21D 8/02* (2006.01)
*C21D 9/00* (2006.01)
*C22C 38/18* (2006.01)

(Continued)

(52) U.S. Cl.

CPC ..... *C21D 9/0068* (2013.01); *C21D 1/28* (2013.01); *C21D 7/13* (2013.01); *C21D 9/00* (2013.01); *C21D 9/40* (2013.01); *C22C 38/00* (2013.01); *C22C 38/001* (2013.01); *C22C 38/02* (2013.01); *C22C 38/04* (2013.01); *C22C 38/06* (2013.01); *C22C 38/18* (2013.01); *C22C 38/20* (2013.01); *C22C 38/22* (2013.01); *C22C 38/24* (2013.01);

(Continued)

(58) Field of Classification Search

CPC ..... C21D 9/0068; C22C 38/44; C22C 38/32
USPC ..... 148/579, 334, 335, 332, 330
See application file for complete search history.

(56) References Cited

FOREIGN PATENT DOCUMENTS

CN 1139458 A 1/1997
CN 1195033 A 10/1998

(Continued)

OTHER PUBLICATIONS

Dec. 11, 2013 Chinese Office Action issued in Chinese Application No. 201180041620.4 with English-language translation.

(Continued)

*Primary Examiner* — Roy King
*Assistant Examiner* — Jenny Wu
(74) *Attorney, Agent, or Firm* — Oliff PLC

(57) ABSTRACT

The present invention provides bearing steel, comprising a chemical composition including by mass %, C: 0.56%≤[% C]≤0.70%, Si: 0.15%≤[% Si]<0.50%, Mn: 0.60%≤[% Mn]≤1.50%, Cr: 0.50%≤[% Cr]≤1.10%, Mo: 0.05%≤[% Mo]≤0.5%, P: [% P]≤0.025%, S: [% S]≤0.025%, Al: 0.005%≤[% Al]≤0.500%, O: [% O]≤0.0015%, N: 0.0030%≤[% N]≤0.015%, and remainder as Fe and incidental impurities.

8 Claims, 9 Drawing Sheets

(51) Int. Cl.

| | |
|---|---|
| ***C21D 1/28*** | (2006.01) |
| ***C21D 7/13*** | (2006.01) |
| ***C21D 9/40*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/20*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/44*** | (2006.01) |

(52) U.S. Cl.

CPC ..... *C22C 38/26* (2013.01); *C22C 38/28* (2013.01); *C22C 38/32* (2013.01); *C22C 38/44* (2013.01)

(56) References Cited

FOREIGN PATENT DOCUMENTS

| | | | |
|---|---|---|---|
| CN | 1266911 | A | 9/2000 |
| CN | 1726295 | A | 1/2006 |
| CN | 1774521 | A | 5/2006 |
| CN | 1950531 | A | 4/2007 |
| CN | 101177728 | A | 5/2008 |
| CN | 101186995 | A | 5/2008 |
| EP | 2 508 637 | A1 | 10/2012 |
| JP | A-1-306542 | | 12/1989 |
| JP | H-02-54739 | | 2/1990 |
| JP | A-3-75312 | | 3/1991 |
| JP | A-3-126839 | | 5/1991 |
| JP | A-3-254341 | | 11/1991 |
| JP | A-04-143253 | | 5/1992 |
| JP | A-5-117804 | | 5/1993 |
| JP | A-5-271866 | | 10/1993 |
| JP | A-7-127643 | | 5/1995 |
| JP | A-9-165643 | | 6/1997 |
| JP | B2-3007834 | | 11/1999 |
| JP | A-2000-144311 | | 5/2000 |
| JP | A-2001-234277 | | 8/2001 |
| JP | A-2006-152407 | | 6/2006 |
| JP | 2007063627 | A * | 3/2007 |
| JP | B2-4050829 | | 12/2007 |
| JP | B2-4066903 | | 1/2008 |
| JP | A-2008-88484 | | 4/2008 |

OTHER PUBLICATIONS

Nov. 7, 2013 Office Action issued in Korean Application No. 10-2013-7007917 (with English Translation).

Aug. 23, 2011 International Search Report issued in International Patent Application No. PCT/JP2011/002886.

Jul. 14, 2014 Extended European Search Report issued in European Patent Application No. 11821237.2.

Sep. 3, 2014 Office Action issued in Chinese Patent Application No. 201180041620.4 (with English translation).

* cited by examiner

BEARING STEEL AND INGOT MATERIAL FOR BEARING HAVING EXCELLENT ROLLING CONTACT FATIGUE LIFE CHARACTERISTICS AND METHOD FOR MANUFACTURING THE SAME

TECHNICAL FIELD

The present invention relates to bearing steel having excellent rolling contact fatigue life characteristics and thus being a suitable material for bearings used in automobile, wind power, transportation equipment, electric machine, precision machine, and other industrial machinery in general. The present invention also relates to a method for manufacturing the bearing steel.

BACKGROUND ART

High carbon chromium steel (JIS G4805: SUJ2) has been widely used as such bearing steel as described above. Bearing steel is generally required to exhibit excellent rolling contact fatigue life characteristics as one of the important characteristics thereof. In this connection, rolling contact fatigue life of a bearing is presumably shortened by presence of nonmetal inclusion or eutectic carbide in bearing steel.

Recent studies have revealed that presence of nonmetal inclusion in bearing steel is presumably the largest factor of causing deterioration of rolling contact fatigue life characteristics of the bearing steel. Content and size of nonmetal inclusion have been therefore controlled by decreasing oxygen content in steel to prolong product life of a bearing.

For example, Patent Literature 1 and Patent Literature 2 each propose a technique of controlling composition, configuration or a distribution state of oxide-based nonmetal inclusion in steel. However, there arises a problem in Patent Literature 1 and Patent Literature 2 that the techniques thereof necessitate either expensive new smelting facilities or significant modification of existing smelting facilities in order to manufacture bearing steel having relatively little nonmetal inclusion.

Patent Literature 3 is a technique of improving rolling contact fatigue life characteristics of bearing steel by controlling degree of central segregation of carbon and contents of oxygen and sulfur in the bearing steel. However, further reducing oxygen content in steel to manufacture bearing steel containing further less nonmetal inclusion necessitates either expensive new smelting facilities or significant modification of existing smelting facilities, which increases a burden on a manufacturer in economical terms, as described above.

In view of the situation described above, attention is now being paid to reducing eutectic carbide in steel, as well as reducing nonmetal inclusion in the steel. High carbon chromium steel described above, containing carbon by at least 0.95 mass % to be very hard and have good wear resistance, exhibits high segregation occurring at the cross-sectional center portion of a casting steel (which segregation will be referred to as "central segregation" hereinafter) and formation of massive eutectic carbide in the casting steel, thereby causing a problem of relatively short rolling contact fatigue life. Due to this problem, the cross-sectional center portion of high carbon chromium steel is punched out (and the center portion thus punched out has to be disposed) or, alternatively, high carbon chromium steel is subjected to a long-hour diffusion treatment (which diffusion treatment will be referred to as "soaking" hereinafter) to sufficiently diffuse segregated element and eutectic carbide from the cross-sectional center portion of the steel.

Patent Literature 4 discloses in order to address the aforementioned segregation problem a method comprising preparing a linear or bar-shaped rolled material having specific chemical composition, e.g. C: 0.6-1.2 mass %, such that the total area of carbide with thickness of at least 2 μm, observed in the center region including the center axis and spreading from the center axis by D/8 on respective sides in a vertical cross section passing through the center axis of the rolled material (D: width of the vertical cross section), is suppressed to 0.3% or less with respect to the area of the vertical cross section. Further, Patent Literature 4 reveals how content of massive carbide quantitatively affects rolling contact fatigue life characteristics, thereby proving that massive eutectic carbide remaining in steel deteriorates rolling contact fatigue life characteristics of the steel.

Patent Literature 5 discloses bearing steel having a specific chemical composition including 0.50-1.50 mass % C, 0.0010-0.0150 mass % Sb and the like and being excellent in heat treatability and productivity with minimal formation of decarburized layer. The technique of Patent Literature 5 aims at, by adding Sb to bearing steel to achieve minimal formation of decarburized layer therein, eliminating cutting or grinding process after thermal treatment of the bearing steel to improve heat treatability and productivity of the steel. However, antimony is suspected to be quite harmful to human body and application of antimony to steel must be discreet. Further, addition of Sb to steel results in concentration of Sb in the central segregation zone of the steel, thereby deteriorating central segregation therein. A portion where Sb has been concentrated of steel exhibits localized hardening, thereby generating difference in hardness between the portion and the base material and thus serving as the origin of rolling contact fatigue fracture to deteriorate rolling contact fatigue life characteristics of the steel.

Patent Literature 6 discloses, in order to diffuse and eliminate central segregation and massive eutectic carbide in the central segregation zone generated during casting of high carbon chromium bearing steel, a method for rolling the cast steel to a billet and subjecting the billet to soaking.

However, there is a problem in the method of Patent Literature 6 in that temperature distribution in steel is uneven during soaking and soaking temperature may locally exceed the temperature corresponding to the solidus curve, which triggers localized re-melting to cause an eutectic reaction to form massive eutectic carbide in the steel.

In view of this, not the aforementioned high carbon chromium steel but low carbon alloy steel is sometimes employed depending on the type of bearing application. For example, case hardening steel is generally utilized as the second option next to high carbon chromium steel. However, it should be noted that case hardening steel, containing carbon by 0.23 mass % or less, necessitates: addition of appropriate amounts of Mn, Cr, Mo, Ni and the like thereto to obtain required hardenability and mechanical strength; and surface hardening by carburizing and carbonitriding to improve fatigue strength of the steel.

For example, Patent Literature 7 discloses case hardening steel obtainable through carburizing treatment in a shortened time by specifying chemical composition thereof (C: 0.10-0.35% and so on) and setting the value of activation energy Q for carbon diffusion in steel defined by formula: $Q=34140-605[\%\,Si]+183[\%\,Mn]+136[\%\,Cr]+122[\%\,Mo]$ to be 34000 kcal or less.

Similarly, Patent Literature 8 discloses a technique regarding a carburized material excellent in rolling contact fatigue characteristics, the material having: a specific chemical composition such as C: 0.1-0.45%; austenite grain size of carburized layer of No. 7 or above; carbon content in a surface of 0.9 to 1.5%; and an amount of retained austenite in the surface of 25 to 40%.

However, there are problems in the techniques of Patent Literature 7 and Patent Literature 8 in that implementation of the aforementioned carburizing and carbonitriding, although it improves rolling contact fatigue life characteristics of steel, significantly increases manufacturing cost and amplifies strains and dimensional changes to decrease production yield, to eventually increase the price of the final product. Further, the aforementioned conventional techniques necessitate significant modification of carburizing/carbonitriding facilities when bearing steel having a large cross section is to be manufactured due to specific bearing application, which increases a burden on the manufacturer in economical terms.

CITATION LIST

Patent Literature

PTL 1: JP-A 01-306542
PTL 2: JP-A 03-126839
PTL 3: JP-A 07-127643
PTL 4: JP-B 3007834
PTL 5: JP-A 05-271866
PTL 6: JP-A 03-075312
PTL 7: JP-B 4066903
PTL 8: JP-B 4050829

SUMMARY OF THE INVENTION

Technical Problems

Sizes of wind turbine generator, transportation equipment and other industrial machinery in general are getting larger year by year and there is an urgent demand for bearing steel having a large cross section for use in these machinery components accordingly. Theoretically, bearing steel having a large cross section can be manufactured by replacing continuous casting as the conventional method for processing a material of bearing steel with ingot casting capable of addressing a wide range of cross sectional dimensions of the material. However, steel manufactured by ingot casting (which steel will be referred to as an "ingot material" or "ingot steel" hereinafter) has a problem in that massive eutectic carbide tends to be formed in a segregation zone such as a V-segregation zone and an inverse V-segregation zone thereof because an ingot material exhibits higher degree of segregation and thus higher possibility of formation of massive eutectic carbide than a continuous cast material. Accordingly, it is important to suppress formation of eutectic carbide in an ingot material.

In view of the situation described above, an object of the present invention is to provide measures to reliably suppress formation of eutectic carbide in a segregation zone in bearing steel in the form of an ingot material in particular, as well as in bearing steel in the form of a continuous cast material.

Solution to the Problems

The inventors of the present invention, as a result of a keen study of the means for solving the aforementioned problems, discovered that it is advantageous and effective, as compared with the conventional bearing steel, to restrict contents of C, Si, Mn, Cr and Al added to bearing steel to specific ranges, introduce novel parameters of "eutectic carbide formation index" and "degree of segregation" and restrict the values of these parameters to specific ranges. That is, the inventors of the present invention newly discovered that it is possible to avoid formation of massive eutectic carbide in a V-segregation and an inverse V-segregation zone, which formation has been problematic in an ingot material in particular, and thus provide bearing steel excellent in rolling contact fatigue life characteristics by carrying out the aforementioned restrictions. Specifically, the inventors of the present invention prepared bearing steel samples where the amount of C, Si, Mn, Cr, Al, and Mo were changed and "eutectic carbide formation index Ec" represented by following formula (1) and "degree of Mo segregation" defined as $C_{Mo(max)}/C_{Mo(ave)}$ (here $C_{Mo(max)}$ represents the maximum value of Mo intensity and $C_{Mo(ave)}$ represents the average value of Mo intensity) were changed, respectively, and keenly studied microstructures and rolling contact fatigue life characteristics of the respective samples. As a result, the inventors discovered that steel without eutectic carbide therein, which exhibits significantly improved rolling contact fatigue life characteristics, can be obtained even in the form of an ingot material as long as the chemical composition, the Ec value and the degree of segregation of the steel satisfy specific ranges, respectively, thereby completing the present invention.

Primary features of the present invention are as follows.

{1}. Bearing steel, comprising a chemical composition including by mass %, C: 0.56% to 0.70% (inclusive of 0.56% and 0.70%), Si: 0.15% to 0.50% (inclusive of 0.15% and exclusive of 0.50%), Mn: 0.60% to 1.50% (inclusive of 0.60% and 1.50%), Cr: 0.50% to 1.10% (inclusive of 0.50% and 1.10%), Mo: 0.05% to 0.5% (inclusive of 0.05% and 0.5%), P: 0.025% or less, S: 0.025% or less, Al: 0.005% to 0.500% (inclusive of 0.005% and 0.500%), O: 0.0015% or less, N: 0.0030% to 0.015% (inclusive of 0.0030% and 0.015%), and remainder as Fe and incidental impurities, wherein "eutectic carbide formation index Ec" represented by following formula (1) is in the range of $0<Ec\leq 0.25$ and "degree of segregation" represented by following formula (2) is equal to or less than 2.8 in the bearing steel.

$$Ec=(-0.07\times[\%\ Si]-0.03\times[\%\ Mn]+0.04\times[\%\ Cr]-0.36\times[\%\ Al]+0.79)-[\%\ C] \quad (1)$$

$$\text{Degree of segregation}=C_{Mo(max)}/C_{Mo(ave)} \quad (2)$$

In formulae (1) and (2), "[% M]" represents content (mass %) of component M and $C_{Mo(max)}$ represents the maximum value of Mo intensity value and $C_{Mo(ave)}$ represents the average value of Mo intensity value, and each intensity value is obtained as explained in Example 1 below through line analysis of a cross section of steel by using an analyzer capable of elemental mapping.

{2}. The bearing steel of {1} above, wherein the chemical composition further includes by mass % at least one type of element selected from: Cu: 0.005% to 0.5% (inclusive of 0.005% and 0.5%), and Ni: 0.005% to 1.00% (inclusive of 0.005% and 1.00%).

{3}. The bearing steel of {1} or {2} above, wherein the chemical composition further includes by mass % at least one type of element selected from: W: 0.001% to 0.5% (inclusive of 0.001% and 0.5%), Nb: 0.001% to 0.1% (inclusive of 0.001% and 0.1%), Ti: 0.001% to 0.1 (inclusive of 0.001% and 0.1%), Zr: 0.001% to 0.1% (inclusive of 0.001% and 0.1%), and V: 0.002% to 0.5% (inclusive of 0.002% and 0.5%).

{4}. The bearing steel of any of {1} to {3} above, wherein the chemical composition further includes by mass %, B: 0.0002% to 0.005% (inclusive of 0.0002% and 0.005%).

{5}. A method for manufacturing bearing steel, comprising: preparing a bearing steel material having the chemical composition of any of {1} to {4} above; and heating the bearing steel material at temperature in the range of 1150° C. to 1350° C. (inclusive of 1150° C. and exclusive of 1350° C.) for a period exceeding 10 hours.

{6}. An ingot material for a bearing, comprising a chemical composition including by mass %, C: 0.56% to 0.70% (inclusive of 0.56% and 0.70%), Si: 0.15% to 0.50% (inclusive of 0.15% and exclusive of 0.50%), Mn: 0.60% to 1.50% (inclusive of 0.60% and 1.50%), Cr: 0.50% to 1.10% (inclusive of 0.50% and 1.10%), Mo: 0.05% to 0.5% (inclusive of 0.05% and 0.5%), P: 0.025% or less, S: 0.025% or less, Al: 0.005% to 0.500% (inclusive of 0.005% and 0.500%), O: 0.0015% or less, N: 0.0030% to 0.015% (inclusive of 0.0030% and 0.015%), and remainder as Fe and incidental impurities, wherein "eutectic carbide formation index Ec" represented by following formula (1) is in the range of $0<Ec\leq 0.25$ and "degree of segregation" represented by following formula (2) is equal to or less than 2.8 in the ingot material.

$$Ec=(-0.07\times[\%\ Si]-0.03\times[\%\ Mn]+0.04\times[\%\ Cr]-0.36\times[\%\ Al]+0.79)-[\%\ C] \quad (1)$$

$$\text{Degree of segregation}=C_{Mo(max)}/C_{Mo(ave)} \quad (2)$$

In formulae (1) and (2), "[% M]" represents content (mass %) of component M and $C_{Mo(max)}$ represents the maximum value of Mo intensity value and $C_{Mo(ave)}$ represents the average value of Mo intensity value.

{7}. The ingot material for a bearing of {6} above, wherein the chemical composition further includes by mass % at least one type of element selected from: Cu: 0.005% to 0.5% (inclusive of 0.005% and 0.5%), and Ni: 0.005% to 1.00% (inclusive of 0.005% and 1.00%).

{8}. The ingot material for a bearing of {6} or {7} above, wherein the chemical composition further includes by mass % at least one type of element selected from: W: 0.001% to 0.5% (inclusive of 0.001% and 0.5%), Nb: 0.001% to 0.1% (inclusive of 0.001% and 0.1%), Ti: 0.001% to 0.1% (inclusive of 0.001% and 0.1%), Zr: 0.001% to 0.1% (inclusive of 0.001% and 0.1%), and V: 0.002% to 0.5% (inclusive of 0.002% and 0.5%).

{9}. The ingot material for a bearing of any of {6} to {8} above, wherein the chemical composition further includes by mass %, B: 0.0002% to 0.005% (inclusive of 0.0002% and 0.005%).

{10}. A method for manufacturing an ingot material for a bearing, comprising: preparing a pre-finished ingot material for a bearing having the chemical composition of any of {6} to {9} above; and heating the pre-finished bearing steel material at temperature in the range of 1150° C. to 1350° C. (inclusive of 1150° C. and exclusive of 1350° C.) for a period exceeding 10 hours.

Advantageous Effect of the Invention

According to the present invention it is possible to stably manufacture bearing steel having much better rolling contact fatigue life characteristics than the conventional bearing steel. The present invention is in particular advantageously applicable to ingot casting capable of addressing a wide range of cross sectional dimensions of bearing steel as required, thereby contributing to increase in size of wind turbine generator, transportation equipment and other industrial machinery in general and thus causing a good effect in industrial terms.

DESCRIPTION OF THE EMBODIMENTS

Figure 1:
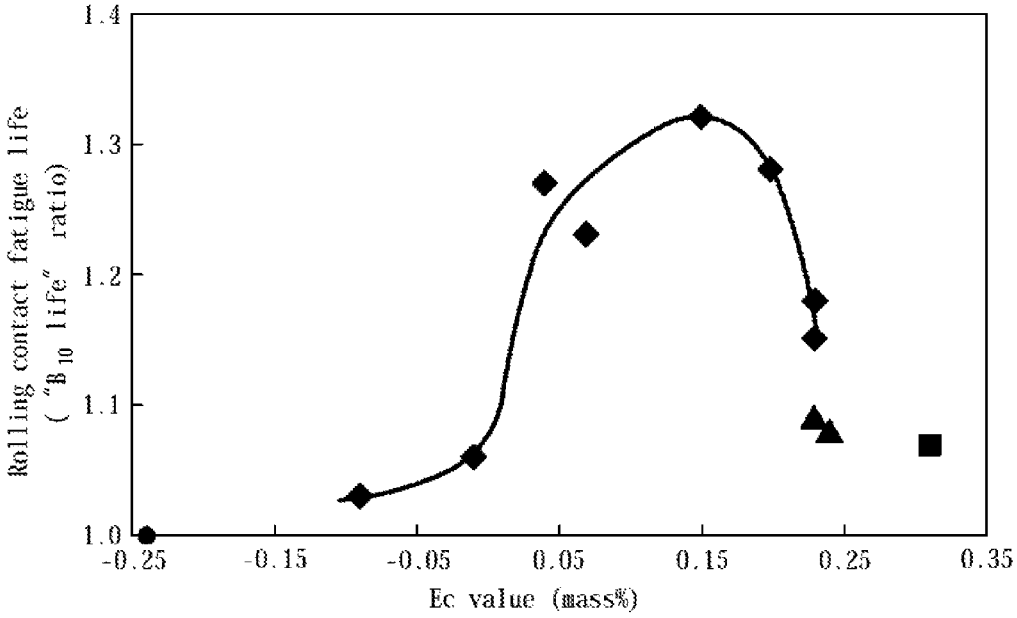
FIG. 1 is a graph showing a relationship between Ec value and rolling contact fatigue life, which relationship was determined through analysis of the evaluation results of the relevant experiments.

Bearing steel of the present invention will be described in detail hereinafter. First, reasons for why contents of respective components of chemical composition are to be specified as described above in the bearing steel of the present invention will be explained one by one.

C: 0.56 Mass % to 0.70 Mass % (Inclusive of 0.56 Mass % and 0.70 Mass %)

Carbon is an effective element in terms of increasing strength and improving rolling contact fatigue life characteristics of steel. Carbon content in steel is to be at least 0.56 mass % in the present invention. However, carbon content in steel exceeding 0.70 mass % results in formation of massive eutectic carbide during casting of a steel material, thereby shortening rolling contact fatigue life of steel. Accordingly, carbon content in steel is to be in the range of 0.56 mass % to 0.70 mass % (inclusive of 0.56 mass % and 0.70 mass %).

Si: 0.15 Mass % to 0.50 Mass % (Inclusive of 0.15 Mass % and Exclusive of 0.50 Mass %)

Silicon, added to steel as deoxidizing agent, is an element which also increases strength of the steel through solute strengthening to improve rolling contact fatigue life characteristics of the steel. Silicon content in steel is to be at least 0.15 mass % in the present invention. However, Si content in steel equal to or higher than 0.50 mass % rather deteriorates machinability by cutting and forgeability of the steel. Further, when Si content in steel is equal to or higher than 0.50 mass %, silicon bonded to oxygen tends to remain as oxide in the steel to deteriorate rolling contact fatigue life characteristics of the steel. Yet further, Si which has been concentrated in a segregation zone facilitates formation of eutectic carbide therein. Accordingly Si content in steel is to be less than 0.50 mass %.

Mn: 0.60 Mass % to 1.50 Mass % (Inclusive of 0.60 Mass % and 1.50 Mass %)

Manganese is an element added to steel to improve quench hardenability, enhance toughness, and improve rolling contact fatigue life characteristics of a steel material. Mn content in steel is to be at least 0.60 mass % in the present invention. However, Mn content in steel exceeding 1.50 mass % deteriorates machinability by cutting of the steel. Further, Mn which has been concentrated in a segregation zone facilitates formation of eutectic carbide therein. Accordingly, Mn content in steel is to be equal to or less than 1.50 mass %.

Cr: 0.50 Mass % to 1.10 Mass % (Inclusive of 0.50 Mass % and 1.10 Mass %)

Chromium, similarly to manganese, is an element added to steel to enhance toughness and improve rolling contact fatigue life characteristics of a steel material. Cr content in steel is to be at least 0.50 mass % in the present invention. However, Cr content in steel exceeding 1.10 mass % deteriorates machinability by cutting of the steel. Accordingly, Cr content in steel is to be equal to or less than 1.10 mass %.

Mo: 0.05 Mass % to 0.5 Mass % (Inclusive of 0.05 Mass % and 0.5 Mass %)

Molybdenum is an element which improves quench hardenability and increases strength after tempering to improve rolling contact fatigue life characteristics of steel. Mo content in steel is to be at least 0.05 mass % in the present invention. However, Mo content in steel exceeding 0.5 mass % facilitates formation of Mo-concentrated layer in a V-segregation zone, an inverse V-segregation zone or a central segregation zone, thereby increasing degree of Mo segregation to deteriorate rolling contact fatigue life characteristics of a resulting steel material. Accordingly, Mo content in steel is to be equal to or less than 0.5 mass %.

P: 0.025 Mass % or Less

Phosphorus is a harmful element which deteriorates toughness of base steel and rolling contact fatigue life characteristics of a resulting steel material. It is therefore preferable to reduce content of phosphorus in steel as best as possible. Phosphorus content in steel exceeding 0.025 mass % in particular significantly deteriorates toughness of base steel and rolling contact fatigue life characteristics of a resulting steel material. Accordingly, phosphorus content in steel is to be equal to or less than 0.025 mass % and preferably is equal to or less than 0.020 mass %. However, phosphors content in steel generally does not drop below 0.002 mass % because reducing phosphorus content in steel to zero % is difficult in industrial terms.

S: 0.025 Mass % or Less

Sulfur exists as MnS, i.e. nonmetal inclusion, in steel. Too much presence of MnS in bearing steel deteriorates rolling contact fatigue life characteristics of the steel because bearing steel, having therein relatively little oxide typically serving as an origin of rolling contact fatigue, is relatively susceptible to an effect of excessive MnS. Accordingly, it is preferable to reduce sulfur content in steel as best as possible. Sulfur content in steel is to be 0.025 mass % or less and preferably 0.020 mass % or less in the present invention. Sulfur content in steel, however, generally does not drop below 0.0001 mass % because reducing sulfur content in steel to zero % is difficult in industrial terms.

Al: 0.005 Mass % to 0.500 Mass % (Inclusive of 0.005 Mass % and 0.500 Mass %)

Aluminum, added to steel as deoxidizing agent, is an element which also forms nitride to make austenite grains fine and thus improve toughness and rolling contact fatigue life characteristics of the steel. Aluminum content in steel is to be at least 0.005 mass % in the present invention. However, Al content in steel exceeding 0.500 mass % results in presence of coarse oxide-based inclusion in the steel, which deteriorates rolling contact fatigue life characteristics of the steel. Further, Al which has been concentrated in a segregation zone facilitates formation of eutectic carbide therein. Accordingly, Al content in steel is to be equal to or less than 0.500 mass % and preferably equal to or less than 0.450 mass %.

O: 0.0015 Mass % or Less

Oxygen is bonded to Si and Al in steel to form hard oxide-based nonmetal inclusion, thereby deteriorating rolling contact fatigue life characteristics of the steel. Accordingly, it is preferable to reduce oxygen content in steel as best as possible. Oxygen content in steel is to be 0.0015 mass % or less in the present invention. Oxygen content in steel, however, generally does not drop below 0.0003 mass % because reducing oxygen content in steel to zero % is difficult in industrial terms.

N: 0.0030% to 0.015% (Inclusive of 0.0030% and 0.015%)

Nitrogen is bonded to aluminum in steel to form nitride-based nonmetal inclusion, thereby making austenite grains fine and thus improving toughness and rolling contact fatigue life characteristics of the steel. Nitrogen content in steel is therefore to be at least 0.0030 mass % in the present invention. However, nitrogen content in steel exceeding 0.015 mass % results in: too much presence of nitride-based inclusion in the steel, which deteriorates rolling contact fatigue life characteristics of the steel; and too much presence of nitrogen not in the fort of nitride (i.e. free nitrogen) in the steel, which deteriorates toughness of the steel. Accordingly, nitrogen content in steel is to be equal to or less than 0.015 mass % and preferably equal to or less than 0.010 mass %.

Eutectic Carbide Formation Index Ec: $0<Ec\leq 0.25$

The inventors of the present invention processed steel samples having various chemical compositions by smelting techniques using a vacuum melting furnace, to obtain ingot steel samples. Presence/absence of eutectic carbide was investigated for each of the ingot steel samples. Calculations for regression analysis were carried out for the results, with variously changing options of parameters (primary influential element), whereby the inventors of the present invention discovered that a steel composition capable of suppressing formation of eutectic carbide must satisfy, when "Ec" represents "eutectic carbide formation index", $0<Ec\leq 0.25$, wherein the eutectic carbide formation index Ec is defined by formula (1) below and "[% M]" represents content (mass %) of component M.

$$Ec=(-0.07\times[\%\ Si]-0.03\times[\%\ Mn]+0.04\times[\%\ Cr]-0.36\times[\%\ Al]+0.79)-[\%\ C] \quad (1)$$

Further, the inventors of the present invention prepared bearing steel samples according to the formulations of chemical compositions and Ec values shown in Table 1 and investigated rolling contact fatigue life characteristics of the bearing steel samples thus prepared. Investigation of rolling contact fatigue life characteristics of the bearing steel samples were carried out in a testing method similar to that of Examples described below.

Figure 3:
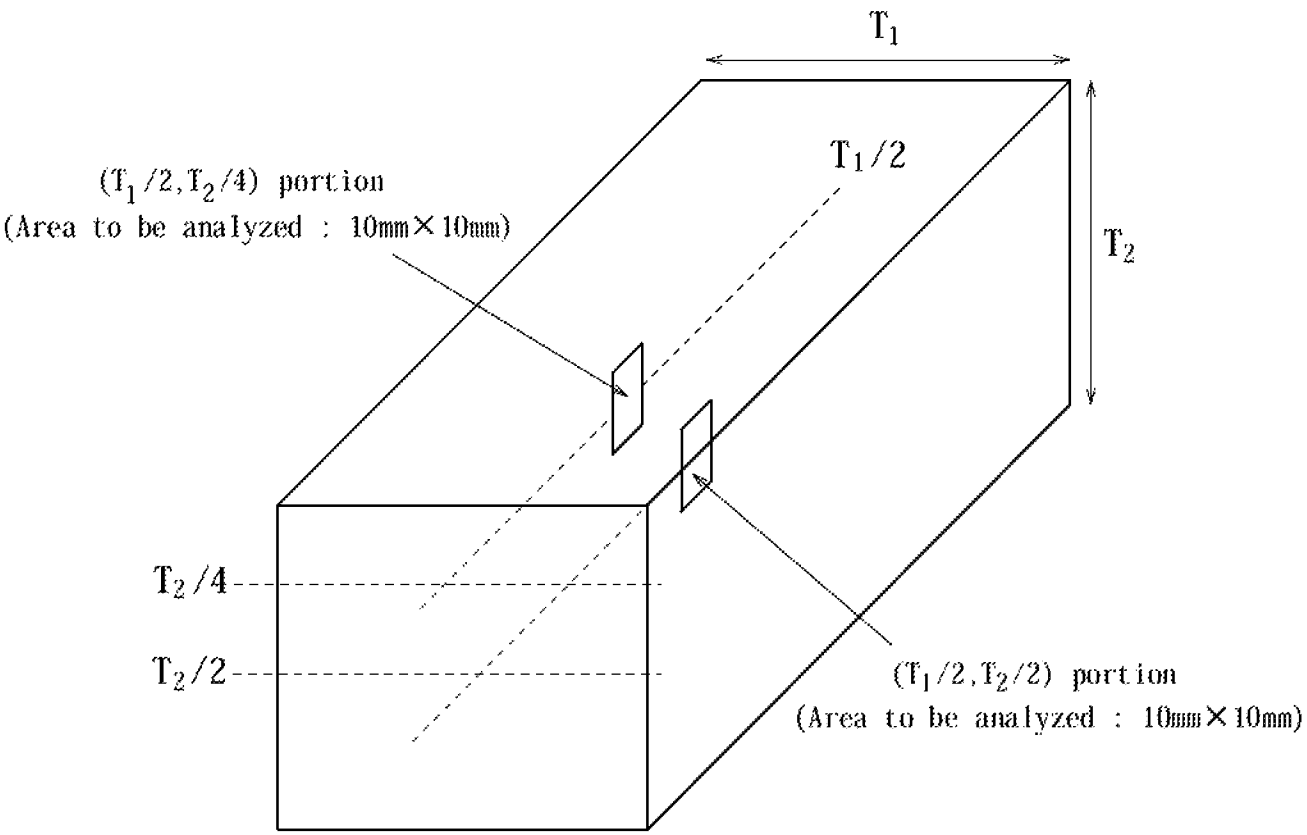
FIG. 3 is a view showing sample-collecting position and size of a surface to be analyzed when a test specimen for microstructure observation is to be collected from a steel billet having been subjected to square forging.
Figure 7:
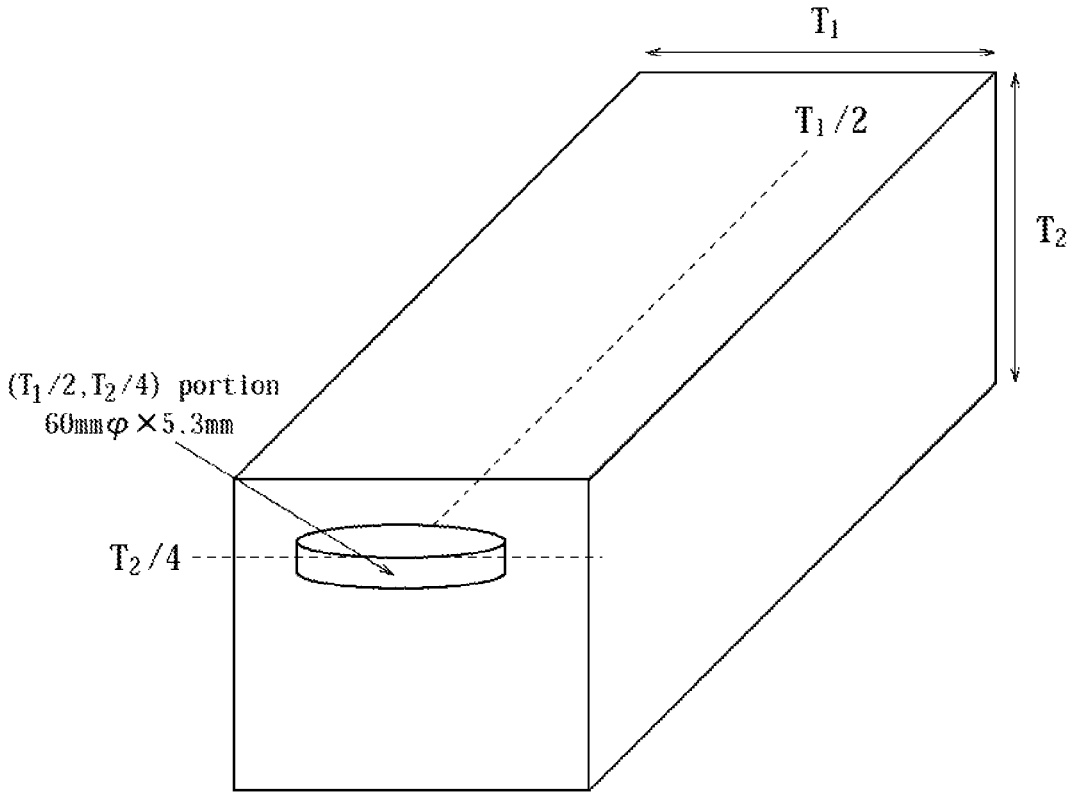
FIG. 7 is a view showing sample-collecting position and size of a test specimen when the test specimen for evaluating rolling contact fatigue life characteristics is to be collected from a steel billet having been subjected to square forging.

Manufacturing conditions other than chemical composition and Ec value of the bearing steel samples were set to be equal among the steel samples in order to investigate how changes in chemical composition and Ec value affect presence/absence of eutectic carbide and rolling contact fatigue life characteristics of the samples. Specifically, The investigation included: preparing ingot samples each having dimensions of 1350 mm×1250 mm cross section (top side) and 1280 mm×830 mm cross section (bottom side) by smelting in a converter and subsequent ingot casting; forging each of the ingot samples to obtain a steel sample having 550 mm square section; subjecting the steel sample thus forged to soaking at 1270° C. for 48 hours; collecting a test specimen for observation of presence/absence of eutectic carbide formation and a test specimen for EPMA (electron probe microanalyzer) mapping analysis, respectively, from the steel sample, as shown in FIG. 3; collecting a test specimen for rolling contact fatigue analysis from the steel sample, as shown in FIG. 7; and investigating presence/absence of formation of eutectic carbide, degree of segregation ($C_{Mo(max)}/C_{Mo(ave)}$), and rolling contact fatigue life characteristics of the steel sample, respectively.

Figure 9:
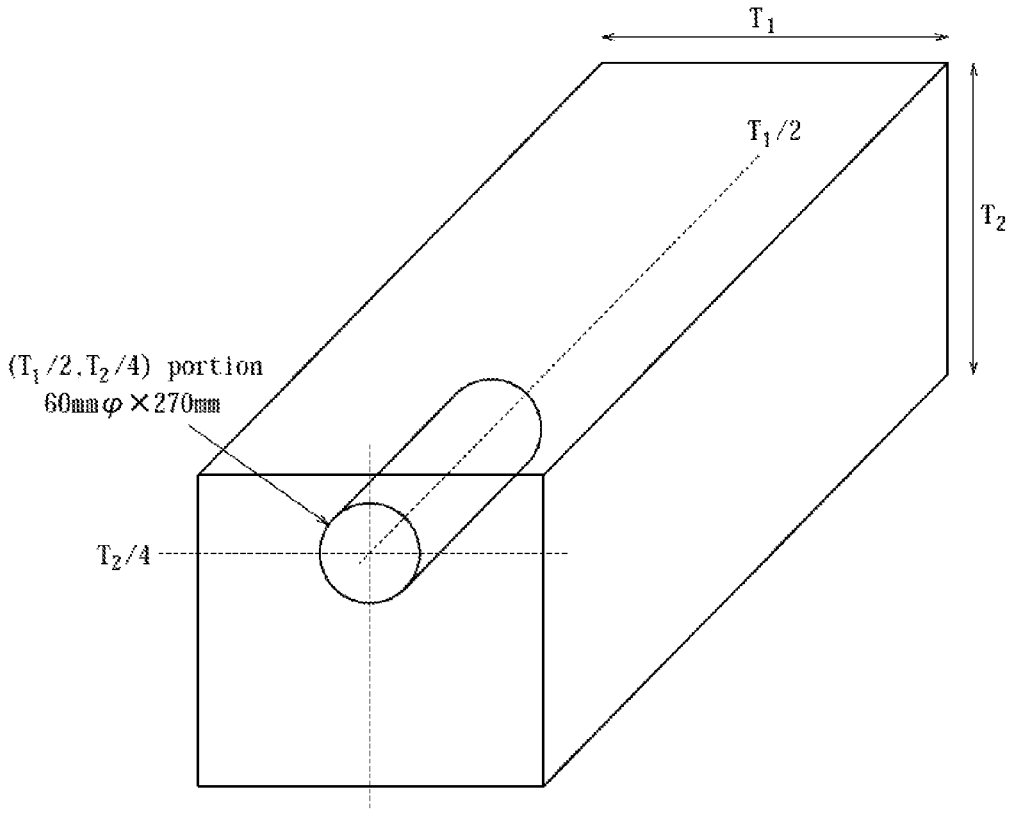
FIG. 9 is a view showing sample-collecting position and size of a test specimen when the test specimen for evaluating machinability by cutting is to be collected from a steel billet having been subjected to square forging.

The test specimens were collected from each steel sample or each billet having been subjected to forging at a portion corresponding to the bottom side of the ingot sample. Finally, a test specimen for evaluating machinability by cutting was collected from the billet having been subjected to forging, as shown in FIG. 9, so that machinability by cutting of the test specimen was carried out according to the testing method described below.

TABLE 1

(mass %)

| Steel sample ID | C | Si | Mn | P | S | Cr | Al | Mo | O | N | Ec | Note |
|---|---|---|---|---|---|---|---|---|---|---|---|---|
| A-1 | 1.05 | 0.25 | 0.45 | 0.016 | 0.008 | 1.45 | 0.025 | 0.18 | 0.0010 | 0.0031 | −0.24 | Reference steel |
| A-2 | 0.69 | 0.46 | 1.23 | 0.011 | 0.003 | 0.52 | 0.021 | 0.17 | 0.0011 | 0.0029 | 0.04 | Example steel |
| A-3 | 0.70 | 0.50 | 1.54 | 0.018 | 0.004 | 0.22 | 0.065 | 0.19 | 0.0010 | 0.0038 | −0.01 | Comp. Ex. steel |
| A-4 | 0.62 | 0.25 | 0.95 | 0.011 | 0.004 | 0.64 | 0.024 | 0.18 | 0.0008 | 0.0052 | 0.15 | Example steel |
| A-5 | 0.58 | 0.10 | 0.74 | 0.014 | 0.005 | 0.73 | 0.021 | 0.18 | 0.0009 | 0.0049 | 0.20 | Example steel |
| A-6 | 0.48 | 0.19 | 0.58 | 0.011 | 0.005 | 1.08 | 0.029 | 0.18 | 0.0010 | 0.0042 | 0.31 | Comp. Ex. steel |
| A-7 | 0.56 | 0.22 | 0.62 | 0.007 | 0.002 | 1.00 | 0.028 | 0.17 | 0.0008 | 0.0036 | 0.23 | Example steel |
| A-8 | 0.55 | 0.24 | 0.63 | 0.008 | 0.003 | 0.06 | 0.021 | 0.19 | 0.0008 | 0.0042 | 0.24 | Comp. Ex. steel |
| A-9 | 0.56 | 0.16 | 0.60 | 0.006 | 0.003 | 1.01 | 0.037 | 0.18 | 0.0008 | 0.0035 | 0.23 | Example steel |
| A-10 | 0.56 | 0.16 | 0.58 | 0.008 | 0.003 | 1.04 | 0.036 | 0.21 | 0.0008 | 0.0031 | 0.23 | Comp. Ex. steel |
| A-11 | 0.70 | 0.50 | 1.50 | 0.011 | 0.000 | 0.51 | 0.340 | 0.17 | 0.0011 | 0.0042 | −0.09 | Comp. Ex. steel |
| A-12 | 0.67 | 0.39 | 0.95 | 0.009 | 0.002 | 0.56 | 0.035 | 0.18 | 0.0009 | 0.0035 | 0.07 | Example steel |

"Example steel" represents steel according to the present invention.
"Comp. Ex. Steel" represents steel out of the scope of the present invention.

The evaluation results of rolling contact fatigue life characteristics are shown in Table 2. Further, a graph showing a relationship between Ec value and rolling contact fatigue life characteristics, which relationship was determined through analysis of these evaluation results, is shown in FIG. 1. When the Ec value≤0, massive eutectic carbide is formed in steel and an increase in the Ec value in this Ec≤0 region hardly improves rolling contact fatigue life characteristics, as compared with the reference sample (A-1), as shown in FIG. 1. However, when the Ec value exceeds zero, however, massive eutectic carbide is no longer formed in steel and rolling contact fatigue life characteristics rapidly improve. When the Ec value exceeds 0.25, content of carbon added to steel decreases, whereby quenched steel cannot reliably have satisfactorily high strength and rolling contact fatigue life characteristics of the steel rather deteriorate. The analyses described above revealed that setting the Ec value to be 0<Ec≤0.25 eliminates formation of eutectic carbide in steel and thus improves rolling contact fatigue life characteristics of the steel. In this connection, sample A-8 having carbon content out of the scope of the present invention and A-10 having Mn content out of the scope of the present invention each exhibited poor strength and thus poor rolling contact fatigue life characteristics of steel, although the Ec values thereof were within the scope of the present invention. Machinability by cutting of each steel sample was evaluated by calculating ratio of tool life of the steel sample with respect to the tool life of the reference steel sample (i.e. tool life of each steel sample/tool life of sample A-1). It has been confirmed that the steel samples having the Ec values and contents of the respective component elements within the scope of the present invention unanimously exhibited longer tool life than the reference steel sample.

TABLE 2

| Steel sample ID | Presence/ absence of eutectic carbide | Ec | $C_{Mo(max)}/C_{Mo(ave)}$ | Rolling contact fatigue life ($B_{10}$ life ratio) | Tool life ratio | Note | Resymbol in FIG. 1 |
|---|---|---|---|---|---|---|---|
| A-1 | Presence | −0.24 | 1.8 | 1.00 | 1.00 | Reference steel | ● |
| A-2 | Absence | 0.04 | 1.7 | 1.27 | 1.20 | Example steel | ◆ |
| A-3 | Presence | −0.01 | 1.9 | 1.06 | 1.20 | Comp. Ex. steel | ◆ |
| A-4 | Absence | 0.15 | 1.8 | 1.32 | 1.22 | Example steel | ◆ |
| A-5 | Absence | 0.20 | 1.8 | 1.28 | 1.24 | Example steel | ◆ |
| A-6 | Absence | 0.31 | 1.8 | 1.07 | 1.23 | Comp. Ex. steel | ■ |
| A-7 | Absence | 0.23 | 1.7 | 1.18 | 1.20 | Example steel | ◆ |
| A-8 | Absence | 0.24 | 1.8 | 1.08 | 1.21 | Comp. Ex. steel | ▲ |
| A-9 | Absence | 0.23 | 1.8 | 1.15 | 1.21 | Example steel | ◆ |
| A-10 | Absence | 0.23 | 2.0 | 1.09 | 1.20 | Comp. Ex. steel | ▲ |
| A-11 | Presence | −0.09 | 1.8 | 1.03 | 1.17 | Comp. Ex. steel | ◆ |
| A-12 | Absence | 0.07 | 1.9 | 1.23 | 1.22 | Example steel | ◆ |

"Example steel" represents steel according to the present invention.
"Comp. Ex. Steel" represents steel out of the scope of the present invention.

In the experiments described above, some steel samples were adjusted to be free of eutectic carbide by controlling the Ec values thereof in order to prove that formation of eutectic carbide in steel facilitates occurrence of rolling contact fatigue starting from eutectic carbide to deteriorate rolling contact fatigue life characteristics of the steel.

Degree of Segregation ($C_{Mo(max)}/C_{Mo(ave)}$)≤2.8

Further, the inventors of the present invention prepared bearing steel samples according to the formulations of chemical compositions and Ec values shown in Table 3 and investigated rolling contact fatigue life characteristics of the bearing steel samples thus prepared. Investigation of rolling contact fatigue life characteristics of the bearing steel samples were carried out in a testing method similar to that of Examples described below. Conditions other than Mo content in steel, i.e. the Ec value, presence/absence of eutectic carbide and the relevant manufacturing conditions, were set to be equal among the steel samples, while Mo content in steel and thus the degree of segregation ($C_{Mo(max)}/C_{Mo(ave)}$) were changed in this experiment in order to investigate how changes in the degree of segregation affect rolling contact fatigue life characteristics of the steel. Specifically, The investigation included: preparing ingot samples each having dimensions of 1350 mm×1250 mm cross section (top side) and 1280 mm×830 mm cross section (bottom side) by smelting in a converter and subsequent ingot casting; forging each of the obtained ingot samples to a steel sample having 800 mm square section; subjecting the steel sample thus forged to soaking at 1270° C. for 48 hours; further forging the steel sample to have 650 mm square section; collecting a test specimen for observation of presence/absence of eutectic carbide formation and a test specimen for EPMA mapping analysis, respectively, from the steel sample, as shown in FIG. 3; collecting a test specimen for rolling contact fatigue analysis from the steel sample, as shown in FIG. 7; collecting a test specimen for evaluating machinability by cutting from the steel sample, as shown in FIG. 9; and investigating presence/absence of formation of eutectic carbide, degree of segregation, rolling contact fatigue life characteristics, and machinability by cutting of the steel sample, respectively.

TABLE 3

(mass %)

| Steel sample ID | C | Si | Mn | P | S | Cr | Al | Mo | O | N | Ec | Note |
|---|---|---|---|---|---|---|---|---|---|---|---|---|
| A-1 | 1.05 | 0.25 | 0.45 | 0.016 | 0.008 | 1.45 | 0.025 | 0.07 | 0.0010 | 0.0031 | −0.24 | Reference steel |
| B-1 | 0.63 | 0.26 | 0.88 | 0.008 | 0.006 | 0.76 | 0.025 | 0.25 | 0.0010 | 0.0031 | 0.14 | Example steel |
| B-2 | 0.61 | 0.31 | 0.92 | 0.011 | 0.005 | 0.88 | 0.025 | 0.32 | 0.0010 | 0.0038 | 0.16 | Example steel |
| B-3 | 0.62 | 0.30 | 0.85 | 0.008 | 0.005 | 0.76 | 0.024 | 0.08 | 0.0008 | 0.0041 | 0.15 | Example steel |
| B-4 | 0.63 | 0.24 | 0.88 | 0.010 | 0.004 | 0.75 | 0.021 | 0.15 | 0.0009 | 0.0039 | 0.14 | Example steel |
| B-5 | 0.64 | 0.31 | 0.83 | 0.011 | 0.005 | 0.77 | 0.025 | 0.49 | 0.0007 | 0.0041 | 0.13 | Example steel |
| B-6 | 0.63 | 0.22 | 0.81 | 0.009 | 0.004 | 0.76 | 0.025 | 0.61 | 0.0009 | 0.0033 | 0.14 | Comp. Ex. steel |

"Example steel" represents steel according to the present invention.
"Comp. Ex. Steel" represents steel out of the scope of the present invention.

Figure 2:
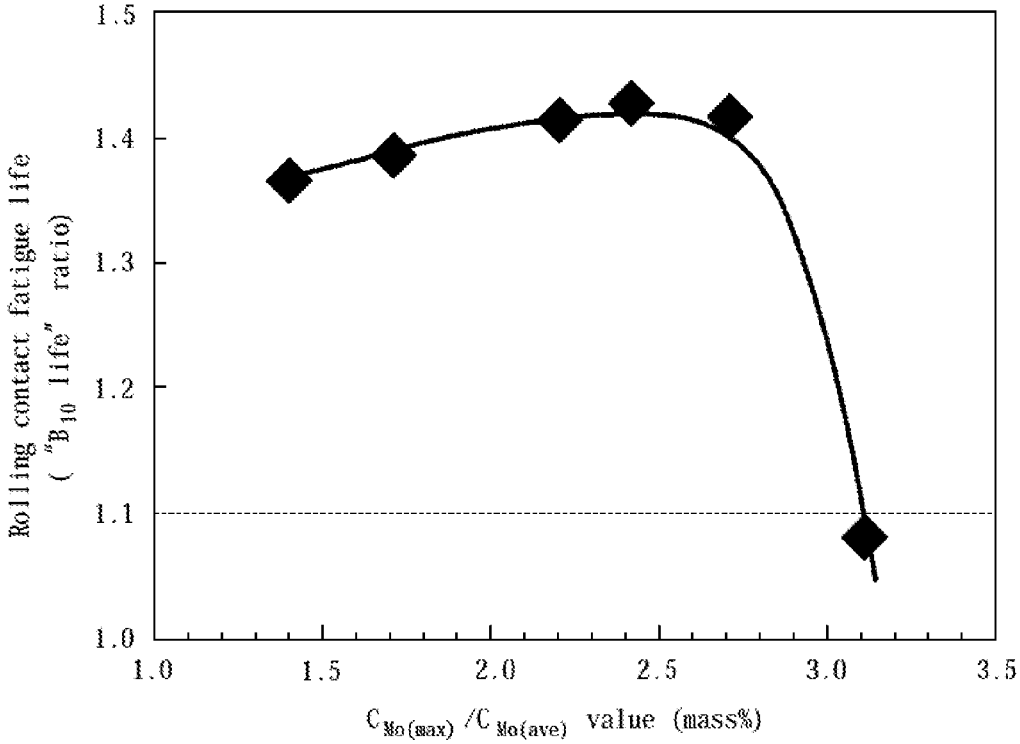
FIG. 2 is a graph showing a relationship between degree of segregation ($C_{Mo(max)}/C_{Mo(ave)}$) and rolling contact fatigue life, which relationship was determined through analysis of the evaluation results of the relevant experiments.

The evaluation results of degree of segregation a rolling contact fatigue life characteristics are shown in Table 4. Further, a graph showing a relationship between degree of segregation $C_{Mo(max)}/C_{Mo(ave)}$ and rolling contact fatigue life characteristics, which relationship was determined through analysis of these evaluation results, is shown in FIG. 2. When the degree of segregation of steel is equal to or less than 2.8, rolling contact fatigue life characteristics of the steel improve. In contrast, when the degree of segregation of steel exceeds 2.8 or deteriorates, rolling contact fatigue life of the steel shrinks. These analyses revealed that setting degree of segregation in steel to be equal to or less than 2.8 improves rolling contact fatigue life characteristics of the steel. The lower limit of degree of segregation is preferably 1.0. Further, it has been confirmed that, although the degree of Mo segregation in steel was changed solely by adjusting Mo content therein in the aforementioned investigation, degree of Mo segregation≤2.8 achieved by controllably adjusting manufacturing conditions other than Mo content (provided that chemical composition within the scope of the present invention is used) likewise significantly improves rolling contact fatigue life characteristics of the steel. Examples of elements other than Mo, which may cause segregation adversely affecting rolling contact fatigue life characteristics in the present invention, include Cr, P and S. Degree of segregation of these elements, as well as that of Mo, must be equal to or less than 2.8. In this connection, the degrees of segregation of Cr, P and S can be suppressed below 2.8, respectively, by setting the degree of segregation of Mo to be equal to or less than 2.8 because diffusion rates of Cr, P and S are each higher than that of Mo. Accordingly, the present invention pays attention to and specifies only the degree of segregation of molybdenum. Machinability by cutting of each steel sample was evaluated by calculating ratio of tool life of the steel sample with respect to the tool life of the reference steel sample. It has been confirmed that the steel samples having the degree of (Mo) segregation and contents of the respective component elements within the scope of the present invention unanimously exhibited longer tool life than the reference steel sample.

TABLE 4

| Steel sample ID | Presence/ absence of eutectic carbide | $C_{Mo(max)}/C_{Mo(ave)}$ | Rolling contact fatigue life ($B_{10}$ life ratio) | Tool life ratio | Note |
|---|---|---|---|---|---|
| A-1 | Presence | 1.8 | 1.00 | 1.00 | Reference |
| B-1 | Absence | 2.2 | 1.42 | 1.22 | Example steel |
| B-2 | Absence | 2.4 | 1.43 | 1.21 | Example steel |

TABLE 4-continued

| Steel sample ID | Presence/ absence of eutectic carbide | $C_{Mo(max)}/C_{Mo(ave)}$ | Rolling contact fatigue life ($B_{10}$ life ratio) | Tool life ratio | Note |
|---|---|---|---|---|---|
| B-3 | Absence | 1.4 | 1.37 | 1.25 | Example steel |
| B-4 | Absence | 1.7 | 1.39 | 1.22 | Example steel |
| B-5 | Absence | 2.7 | 1.42 | 1.20 | Example steel |
| B-6 | Absence | 3.1 | 1.08 | 1.16 | Comp. Ex. steel |

"Example steel" represents steel according to the present invention.
"Comp. Ex. Steel" represents steel out of the scope of the present invention.

The present invention, which makes it possible to suppress formation of eutectic carbide in an ingot steel material manufactured by ingot casting, causes a particularly good effect when it is applied to an ingot steel material manufactured by ingot casting. Consequently, the present invention causes a superior effect that bearing steel products having a wide range of cross sectional dimensions, of good quality, can be flexibly manufactured by ingot casting.

Following respective components (at least one type of element selected from groups A-C shown below), as well as the aforementioned basic components, may be appropriately added to the bearing steel of the present invention.

Group A

At Least One Type of Element Selected from Cu: 0.005 Mass % to 0.5 Mass % and Ni: 0.005 Mass % to 1.00 Mass %

Copper and nickel are elements which each improve quench hardenability and increase strength after tempering to improve rolling contact fatigue life characteristics of steel. Selection and degree of addition of Cu and Ni may be determined depending on the required strength of steel. Cu and/or Ni content is preferably at least 0.005 mass % in order to obtain the good effects caused by addition of these elements. However, Cu content in steel exceeding 0.5 mass % and Ni content in steel exceeding 1.00 mass % rather deteriorate machinability by cutting of the steel. Accordingly, Cu and Ni are preferably added to steel such that contents thereof do not exceed the upper limits described above, respectively.

Group B

Similarly, following components, as well as the aforementioned components, may be added to the bearing steel of the present invention in order to increase strength and improve rolling contact fatigue life characteristics of the steel.

At Least One Type of Element Selected from: W (0.001 Mass % to 0.5 Mass %); Nb (0.001 Mass % to 0.1 Mass %); Ti (0.001 Mass % to 0.1 Mass %); Zr (0.001 Mass % to 0.1 Mass %); and V (0.002 Mass % to 0.5 Mass %)

W, Nb, Ti, Zr and V are elements which each improve quench hardenability and increase strength after tempering to improve rolling contact fatigue life characteristics of steel. Selection (specifically, any one of W, Nb, Ti, Zr, V, W+Nb, W+Ti, W+Zr, W+V, Nb+Ti, Nb+Zr, Nb+V, Ti+Zr, Ti+V, Zr+V, W+Nb+Ti, W+Nb+Zr, W+Nb+V, W+Ti+Zr, W+Ti+V, W+Zr+V, Nb+Ti+Zr, Nb+Ti+V, Nb+Zr+V, Ti+Zr+V, W+Nb+Ti+Zr, W+Nb+Ti+V, W+Nb+Zr+V, W+Ti+Zr+V, Nb+Ti+Zr+V, and W+Nb+Ti+Zr+V) and degree of addition of W, Nb, Ti, Zr and V may be determined depending on the required strength of steel. Contents of any of W, Nb, Ti, and Zr thus selected are preferably at least 0.001 mass %, respectively, and content of V is preferably at least 0.002 mass % in order to obtain the good effects caused by these elements. However, W and V contents in steel exceeding 0.5 mass % and Nb, Ti and Zr contents in steel exceeding 0.1 mass % rather deteriorate machinability by cutting of the steel. Accordingly, W, Nb, Ti, Zr and V are preferably added to steel such that contents thereof do not exceed the upper limits described above, respectively.

Group C

B: 0.0002 Mass % to 0.005 Mass %

Boron, which is an element improving quench hardenability and increasing strength after tempering to improve rolling contact fatigue life characteristics of steel, may be added to steel according to necessity. Content of boron is preferably at least 0.0002 mass % in order to obtain the good effect caused by the element. However, boron content in steel exceeding 0.005 mass % deteriorates formability of the steel. Accordingly, boron is preferably added to steel such that content thereof is within the range of 0.0002 mass % to 0.005 mass %.

Components other than those described above of the bearing steel of the present invention are Fe and incidental impurities. Examples of the incidental impurities include Sn, Sb, As, Ca and the like, with no limitation thereto.

Next, manufacturing conditions of the bearing steel of the present invention will be described.

A steel material having the aforementioned chemical composition is smelted in a vacuum melting furnace or a converter and further by a known refining method, such as degassing process, and then subjected to ingot casting or continuous casting such that a billet is obtained. The present invention, which can prevent eutectic carbide from being formed when a billet is prepared by ingot casting susceptible to precipitation of eutectic carbide, is advantageously applicable to production of an ingot steel material and a billet having large cross sectional dimensions. Cast billet thus obtained is further subjected to forming processes such as rolling and forging, so that bearing parts are obtained. Cast billet must be subjected to a treatment for decreasing the aforementioned degree of Mo segregation to 2.8 or less because segregation of Mo has occurred in the cross-sectional center portion of the billet. This treatment necessitates heating process described below.

Heating Temperature: 1150° C. to 1350° C. (Inclusive of 1150° C. and Exclusive of 1350° C.)

The degree of Mo segregation in the central segregation zone must be decreased in order to improve rolling contact fatigue life characteristics of steel. Segregation in the casting direction (V-segregation) and segregation in the direction opposite to the casting direction (inverse V-segregation), which tend to be generated in the vicinity of the cross-sectional center portion of the billet when the billet is prepared by ingot casting, can be mitigated by heating the billet under predetermined conditions. When heating temperature is lower than 1150° C., decrease in the degree of segregation is insufficient and a satisfactory heating effect cannot be obtained. Heating temperature equal to or higher than 1350° C. induces melting in a portion having relatively high degree of segregation, thereby possibly cracking the steel material. Accordingly, the heating temperature is to be in the range of 1150° C. to 1350° C. (inclusive of 1150° C. and exclusive of 1350° C.).

Retention (Soaking) Time: Longer than 10 Hours

The degree of Mo segregation, V-segregation and inverse V-segregation in steel must be decreased or mitigated in order to improve rolling contact fatigue life characteristics of steel, as described above. Increasing the heating temperature is effective in terms of decreasing the degree of segregation but there is inevitably a limit to such an increase in temperature. The billet is therefore retained at the heating temperature for a period longer than 10 hours, so that the degree of segregation decreases. Retention time equal to or shorter than 10 hours cannot decrease the degree of segregation sufficiently, whereby a satisfactory soaking effect cannot be obtained. Accordingly, retention time at the heating temperature is to exceed 10 hours in the present invention.

The heating treatment may be carried out as a series of plural heating processes as long as the total retention time at temperature in the range of 1150° C. to 1350° C. (inclusive of 1150° C. and exclusive of 1350° C.) during these processes exceeds 10 hours. The heating treatment may be carried out either as pre-forging heating, i.e. as a process of heating the billet prior to hot forging for forming the billet into a desired cross sectional configuration or as a heating process of the billet independent of pre-forging heating. It is acceptable to heat the billet under the aforementioned conditions after hot forging. Anyway, heating treatment for a billet derived from an ingot steel is essential in order to achieve the degree of Mo segregation≤2.8 required of the billet or an ingot steel material for a bearing.

Example 1

Steel samples having respective chemical compositions shown in Table 5 were processed by smelting techniques using a converter and subsequent ingot casting or continuous casting, so that ingot samples having sizes shown in Table 6 were obtained. Each of the ingot samples thus obtained was subjected to forging and heating under the corresponding conditions shown in Table 6, whereby a billet sample having square cross section (650 mm×650 mm) was obtained. Presence/absence of eutectic carbide, degree of segregation, rolling contact fatigue life characteristics, and machinability by cutting of the billet sample having been subjected to forging were investigated as described below.

TABLE 5

(mass %)

| Steel sample ID | C | Si | Mn | P | S | Cr | Al | Mo | O | N | Ec | Note |
|---|---|---|---|---|---|---|---|---|---|---|---|---|
| A-1 | 1.05 | 0.25 | 0.45 | 0.016 | 0.008 | 1.45 | 0.025 | 0.07 | 0.0010 | 0.0031 | −0.24 | Reference steel |
| C-1 | 0.64 | 0.25 | 0.83 | 0.011 | 0.006 | 0.79 | 0.026 | 0.25 | 0.0010 | 0.0031 | 0.13 | Example steel |
| C-2 | 0.60 | 0.31 | 0.81 | 0.009 | 0.004 | 0.77 | 0.024 | 0.45 | 0.0009 | 0.0041 | 0.17 | Example steel |
| C-3 | 0.63 | 0.25 | 0.89 | 0.008 | 0.006 | 0.81 | 0.024 | 0.55 | 0.0008 | 0.0039 | 0.14 | Comp. Ex. steel |

"Example steel" represents steel according to the present invention.

"Comp. Ex. Steel" represents steel out of the scope of the present invention.

TABLE 6

| No. | Used steel sample ID | Cross sectional dimensions after casting (mm) Top side | Bottom side | Material type | Cross sectiona dimensions after forging (mm) Cross sectional configuration※ | Cross sectional dimension | Manfacturing condition** | Heating 1 Heating temperature (° C.) | Retention time (hour) | Heating 2 Heating temperature (° C.) | Retention time (hour) | Heating 3 Heating temperature (° C.) | Retention time (hour) | Total soaking (heating and retention) time at temperature (T) of 1150° C. ≤ T ≤ 1350° C. | Note |
|---|---|---|---|---|---|---|---|---|---|---|---|---|---|---|---|
| 1 | A-1 | 1340 × 1230 | 1280 × 860 | Ingot steel | □ | 650 | B | 1200 | 10 | 1270 | 48 | — | — | 58 | Reference steel |
| 2 | C-1 | 1340 × 1230 | 1280 × 860 | Ingot steel | □ | 650 | A | 1200 | 48 | — | — | — | — | 48 | Example steel |
| 3 | C-1 | 1340 × 1230 | 1280 × 860 | Ingot steel | □ | 650 | B | 1270 | 15 | 1270 | 20 | — | — | 35 | Example steel |
| 4 | C-1 | 1340 × 1230 | 1280 × 860 | Ingot steel | □ | 650 | B | 1200 | 10 | 1270 | 100 | — | — | 110 | Example steel |
| 5 | C-1 | 1340 × 1230 | 1280 × 860 | Ingot steel | □ | 650 | C | 1270 | 5 | 1270 | 16 | — | — | 20 | Example steel |
| 6 | C-1 | 1340 × 1230 | 1280 × 860 | Ingot steel | □ | 660 | D | 1350 | 10 | 1150 | 2 | 1350 | 2 | 14 | Example steel |
| 7 | C-1 | 1340 × 1230 | 1280 × 860 | Ingot steel | □ | 660 | C | 1160 | 5 | 1150 | 3 | — | — | 8 | Comp. Ex. steel |
| 8 | C-1 | 1340 × 1230 | 1280 × 860 | Ingot steel | □ | 660 | C | 1100 | 10 | 1100 | 10 | — | — | 0 | Comp. Ex. steel |
| 9 | C-2 | 1340 × 1230 | 1280 × 860 | Ingot steel | □ | 650 | A | 1270 | 72 | — | — | — | — | 72 | Example steel |
| 10 | C-2 | 1340 × 1230 | 1280 × 860 | Ingot steel | □ | 650 | B | 1200 | 10 | 1270 | 31 | — | — | 41 | Example steel |
| 11 | C-2 | 1340 × 1230 | 1280 × 860 | Ingot steel | □ | 650 | C | 1200 | 15 | 1270 | 41 | — | — | 56 | Example steel |
| 12 | C-2 | 1340 × 1230 | 1280 × 860 | Ingot steel | □ | 650 | D | 1100 | 10 | 1100 | 5 | 1300 | 48 | 63 | Example steel |
| 13 | C-2 | 1340 × 1230 | 1280 × 860 | Ingot steel | □ | 650 | B | 1270 | 72 | 1270 | 72 | — | — | 144 | Example steel |
| 14 | C-2 | 1340 × 1230 | 1280 × 860 | Ingot steel | □ | 650 | D | 1250 | 10 | 1270 | 20 | 1250 | 48 | 78 | Example steel |
| 15 | C-3 | 1340 × 1230 | 1280 × 860 | Ingot steel | □ | 650 | A | 1300 | 48 | — | — | — | — | 48 | Comp. Ex. steel |
| 16 | C-3 | 1340 × 1230 | 1280 × 860 | Ingot steel | □ | 650 | B | 1250 | 10 | 1270 | 30 | — | — | 40 | Comp. Ex. steel |
| 17 | C-3 | 1340 × 1230 | 1280 × 860 | Ingot steel | □ | 650 | C | 1250 | 6 | 1270 | 20 | — | — | 25 | Comp. Ex. steel |
| 18 | C-3 | 1340 × 1230 | 1280 × 860 | Ingot steel | □ | 650 | D | 1300 | 10 | 1300 | 40 | 1300 | 40 | 90 | Comp. Ex. steel |
| 19 | C-1 | 1400 × 460 | 1400 × 450 | Continuous cast steel | □ | 660 | C | 1270 | 5 | 1270 | 10 | — | — | 16 | Example steel |
| 20 | C-1 | 1400 × 460 | 1400 × 450 | Continuous cast steel | □ | 660 | D | 1270 | 5 | 1270 | 6 | 1270 | 20 | 30 | Example steel |
| 21 | C-1 | 1400 × 460 | 1400 × 450 | Continuous cast steel | □ | 660 | B | 1270 | 16 | 1270 | 10 | — | — | 26 | Example steel |
| 22 | C-1 | 1400 × 460 | 1400 × 450 | Continuous cast steel | □ | 660 | D | 1270 | 5 | 1270 | 6 | 1270 | 30 | 40 | Example steel |
| 23 | C-1 | 1400 × 460 | 1400 × 450 | Continuous cast steel | □ | 660 | B | 1270 | 10 | 1270 | 10 | — | — | 20 | Example steel |
| 24 | C-1 | 1400 × 450 | 1400 × 450 | Continuous cast steel | □ | 650 | C | 1270 | 10 | 1270 | 10 | — | — | 20 | Example steel |

※□ represents square forging.
**Manufacturing condition
A: (casting)-heating 1-forging
B: (casting)-heating 1-forging-heating 2
C: (casting)-heating 1-forging-heating 2-forging
D: (casting)-heating 1-forging-heating 2-forging-heating 3
"Example steel" represents steel according to the present invention.
"Comp. Ex. Steel" represents steel out of the scope of the present invention.

[Presence/Absence of Eutectic Carbide]

Presence/absence of eutectic carbide was analyzed by: setting a specimen-collecting position at ($T_1/2$, $T_2/2$) portion as the cross sectional center and another specimen-collecting position at ($T_1/2$, $T_2/4$) portion of each of the billet samples after square forging, wherein $T_1$ and $T_2$ represent lengths of sides of square cross section of the billet, respectively, and $T_1=T_2$, as shown in FIG. 3; collecting test specimens for microstructure observation from these specimen-collecting positions of the billet, respectively, such that surfaces to be observed of the specimens correspond to a cross section in the extension direction of the billet; etching the surfaces to be observed by using 3% nital; and observing the etched surfaces of the specimens by using a scanning electron microscope (SEM, ×500) to determine presence/absence of eutectic carbide. An area of 10 mm×10 mm was analyzed for each of the etched surfaces of the specimens. The test specimens were collected from a portion corresponding to the bottom side of the ingot steel/the continuous cast steel, of the billet having been subjected to forging, respectively.

[Degree of Segregation]

Figure 5:
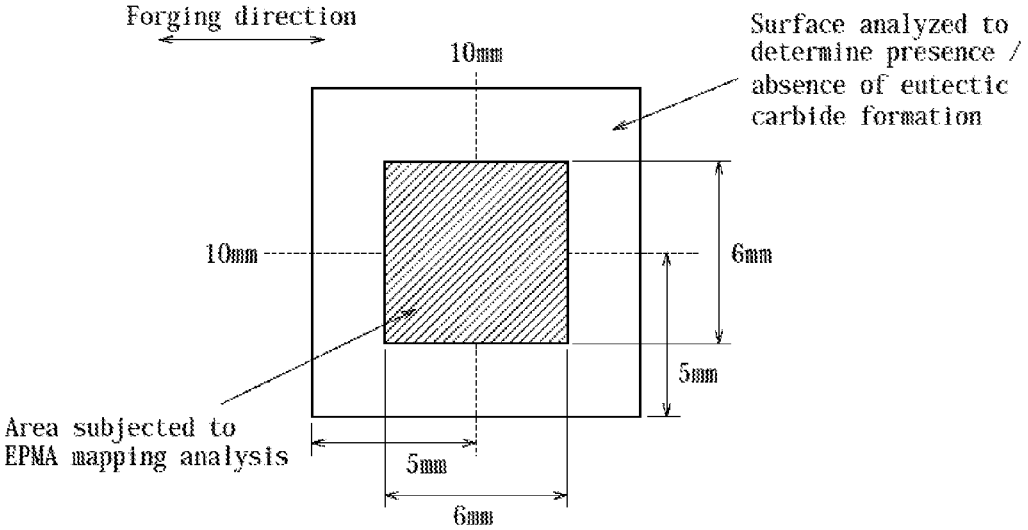
FIG. 5 is a view showing area to be analyzed through EPMA.
Figure 6:
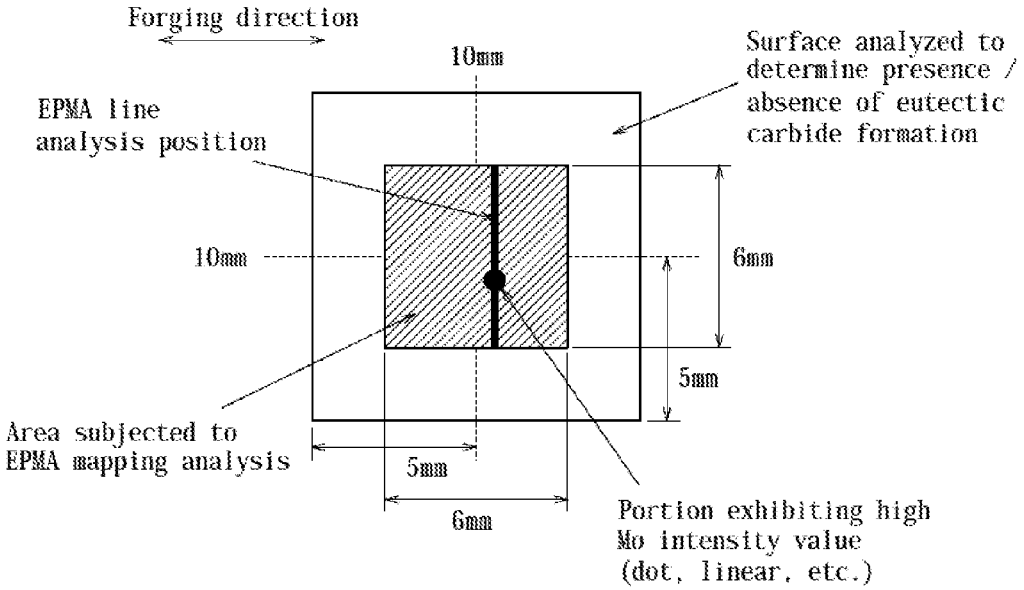
FIG. 6 is a view showing a position at which line analysis is to be carried out in EPMA.

Degree of segregation was determined with an electron probe microanalyzer (which will be referred to as "EPMA" hereinafter) by utilizing the aforementioned test specimens for microstructure observation used for evaluating presence/absence of eutectic carbide. Specifically, degree of segregation was investigated by: carrying out area-analysis of the center portion (6 mm×6 mm) of each of the test specimens as shown in FIG. 5 under measuring conditions of EPMA including beam diameter of 30 μmϕ, acceleration voltage of 20 kV, and electric current of $4\times10^{-7}$ A; then carrying out line-analysis, as shown in FIG. 6, along a line including a portion exhibiting a relatively high Mo intensity value (i.e. a portion where Mo segregation has occurred) in the region where the area-analysis was carried out; determining the maximum value $C_{Mo(max)}$ of Mo intensity value and the average $C_{Mo(ave)}$ of the Mo intensity value, respectively; and calculating ratio of the maximum value of the Mo intensity with respect to the average thereof, i.e. $C_{Mo(max)}/C_{Mo(ave)}$, to regard the ratio as the degree of Mo segregation. The test specimens were collected from a portion corresponding to the bottom side of the ingot steel/the continuous cast steel, of the billet having been subjected to forging, respectively.

[Rolling Contact Fatigue Life Characteristics]

Rolling contact fatigue life characteristics would ideally be evaluated by actually subjecting to ingot steel/continuous cast steel to forging, cutting, quenching, tempering and using a resulting product for a while. However, such ideal evaluation takes a long time. Rolling contact fatigue life characteristics of the billet were therefore evaluated by using a thrust type rolling contact fatigue tester in Example 1. Specifically, rolling contact fatigue was measured by: setting a specimen-collecting position at ($T_1/2$, $T_2/4$) portion of each of the billet samples after square forging, wherein $T_1$ and $T_2$ represent lengths of sides of square cross section of the billet, respectively, and $T_1=T_2$, as shown in FIG. 7; cutting a disc-shaped test specimen (60 mmϕ×5.3 mm) from the specimen-collecting position of the billet; heating the disc-shaped specimen to 950° C. and retaining the test specimen at the temperature for 20 minutes; quenching the test specimen in oil at 25° C.; subjecting the test specimen to tempering by heating the test specimen to 170° C. and retaining it at the temperature for 1.5 hours; subjecting the disc-shaped test specimen thus treated (60 mmϕ×5 mm) to flat polishing to finish a surface to be tested into a mirror surface: then subjecting the test specimen to a rolling contact fatigue test by making steel balls roll on the periphery (diameter: approximately 38 mm) of the test specimen with maximum Hertzian contact stress of 5.8 GPa exerted thereon by using the thrust type rolling contact fatigue tester. The test specimen was collected from a portion corresponding to the bottom side of the ingot steel/the continuous cast steel, of the billet having been subjected to forging.

Rolling contact fatigue life characteristics were evaluated by: counting for each of 10 to 15 test specimens the number of stress loading before exfoliation occurs in the test specimen; analyzing a relationship between the number of stress loading vs. cumulative fracture probability by using Weibull probability paper; and determining cumulative fracture probability of 10% as "$B_{10}$ life"; and judging that rolling contact fatigue life characteristics of a test specimen have improved, as compared with those of the reference steel sample (A-1: steel corresponding to SUJ2), when "$B_{10}$ life" of the former has increased by at least 10%, as compared with "$B_{10}$ life" of the latter.

[Machinability by Cutting]

Machinability by cutting would ideally be evaluated by actually subjecting to ingot steel/continuous cast steel to forging, cutting, quenching, tempering and finish cutting. However, such ideal evaluation takes a long time. Machinability by cutting of the billet was therefore evaluated by conducting a peripheral lathe turning test described below in Example 1. Specifically, machinability by cutting was determined by: setting a specimen-collecting position at ($T_1/2$, $T_2/4$) portion of each of the billet samples after square forging, wherein $T_1$ and $T_2$ represent lengths of sides of square cross section of the billet, respectively, and $T_1=T_2$, as shown in FIG. 9; cutting a round bar-shaped test specimen (60 mmϕ×270 mm) from the specimen-collecting position of the billet; heating the round bar-shaped specimen to 950° C. and retaining the test specimen at the temperature for 20 minutes; quenching the test specimen in oil at 25° C.; subjecting the test specimen to tempering by heating the test specimen to 170° C. and retaining it at the temperature for 1.5 hours; then subjecting the test specimen to a peripheral lathe turning test by using a peripheral lathe turning tester, i.e. a super-hard (P10) cutting tool, without using lubricant under the conditions including cutting speed of 120 mm/min, feeding speed of 0.2 m/rev., and cut depth of 1.0 mm, to count time before an amount of flank wear of the cutting tool reaches 0.2 mm; regarding the time thus counted as "tool life"; dividing the tool life value exhibited by each of the respective steel samples, by the tool life value exhibited by the reference steel sample (A-1: steel corresponding to SUJ2), to obtain a "tool life ratio" (=tool life of the steel sample/tool life of the reference steel corresponding to SUJ2); and judging that machinability by cutting of a test specimen have improved, as compared with that of the reference steel sample, when the tool life ratio of the test specimen is at least 1.15.

The results of presence/absence of eutectic carbide, degree of segregation, and the rolling contact fatigue life characteristics test are shown in Table 7. It is understood from these results that steel samples Nos. 2 to 6, Nos. 9 to 14 and Nos. 19 to 24 each satisfying the chemical composition, the Ec value and the degree of segregation $C_{Mo(max)}/C_{Mo(ave)}$ within the scope of the present invention unanimously exhibit no presence of eutectic carbide in steel, the degrees of segregation within the range specified in the present invention, and satisfactorily good rolling contact fatigue life characteristics. In contrast, steel samples No. 7 and No. 8, each having the chemical composition within the scope of the present invention but of which manufacturing conditions fail to be within the scope of the present invention, exhibit too high degrees of segregation and thus poor rolling contact fatigue life characteristics, respectively. Further, steel samples Nos. 15 to 18, each having the manufacturing conditions within the scope of the present invention but of which chemical compositions fail to be within the scope of the present invention, exhibit insufficient decrease in degree of segregation, i.e. too high degrees of segregation, and thus poor rolling contact fatigue life characteristics, respectively.

TABLE 7

| Test results | | | | | |
|---|---|---|---|---|---|
| Steel sample ID | Presence/ absence of eutectic carbide | $C_{Mo(max)}/C_{Mo(ave)}$ | Rolling contact fatigue life ($B_{10}$ life ratio) | Tool life ratio | Note |
| 1 | Presence | 1.8 | 1.00 | 1.00 | Reference steel |
| 2 | Absence | 2.1 | 1.41 | 1.22 | Example steel |
| 3 | Absence | 2.4 | 1.40 | 1.20 | Example steel |
| 4 | Absence | 1.4 | 1.39 | 1.23 | Example steel |
| 5 | Absence | 2.3 | 1.41 | 1.21 | Example steel |
| 6 | Absence | 2.3 | 1.40 | 1.21 | Example steel |
| 7 | Absence | 3.3 | 1.06 | 1.16 | Comp. Ex. steel |
| 8 | Absence | 3.4 | 1.05 | 1.16 | Comp. Ex. steel |
| 9 | Absence | 2.7 | 1.38 | 1.19 | Example steel |
| 10 | Absence | 2.4 | 1.43 | 1.20 | Example steel |
| 11 | Absence | 2.4 | 1.41 | 1.20 | Example steel |
| 12 | Absence | 2.1 | 1.40 | 1.21 | Example steel |
| 13 | Absence | 1.8 | 1.38 | 1.23 | Example steel |
| 14 | Absence | 2.3 | 1.39 | 1.21 | Example steel |
| 15 | Absence | 3.4 | 1.06 | 1.15 | Comp. Ex. steel |
| 16 | Absence | 3.5 | 1.06 | 1.16 | Comp. Ex. steel |
| 17 | Absence | 4.2 | 1.04 | 1.15 | Comp. Ex. steel |
| 18 | Absence | 3.0 | 1.07 | 1.15 | Comp. Ex. steel |
| 19 | Absence | 1.9 | 1.40 | 1.24 | Example steel |
| 20 | Absence | 2.4 | 1.37 | 1.20 | Example steel |
| 21 | Absence | 2.0 | 1.41 | 1.22 | Example steel |
| 22 | Absence | 2.5 | 1.36 | 1.20 | Example steel |
| 23 | Absence | 2.0 | 1.40 | 1.22 | Example steel |
| 24 | Absence | 1.9 | 1.42 | 1.23 | Example steel |

"Example steel" represents steel according to the present invention.

"Comp. Ex. Steel" represents steel out of the scope of the present invention.

Example 2

Steel samples having respective chemical compositions shown in Table 8 were processed by smelting techniques using a converter and subsequent ingot casting, so that ingot samples having sizes shown in Table 9 were obtained. Each of the ingot samples thus obtained was heated to 1270° C., retained at the temperature for 15 hours, and subjected to forging to be a billet having either square cross section (side length in the range of 450 mm to 750 mm) or circular cross section (diameter in the range of 450 mm to 800 mm). The billet thus subjected to forging was then subjected to a thermal treatment including heating the billet to 1270° C. and retaining the billet at the temperature for 20 hours.

Figure 4:
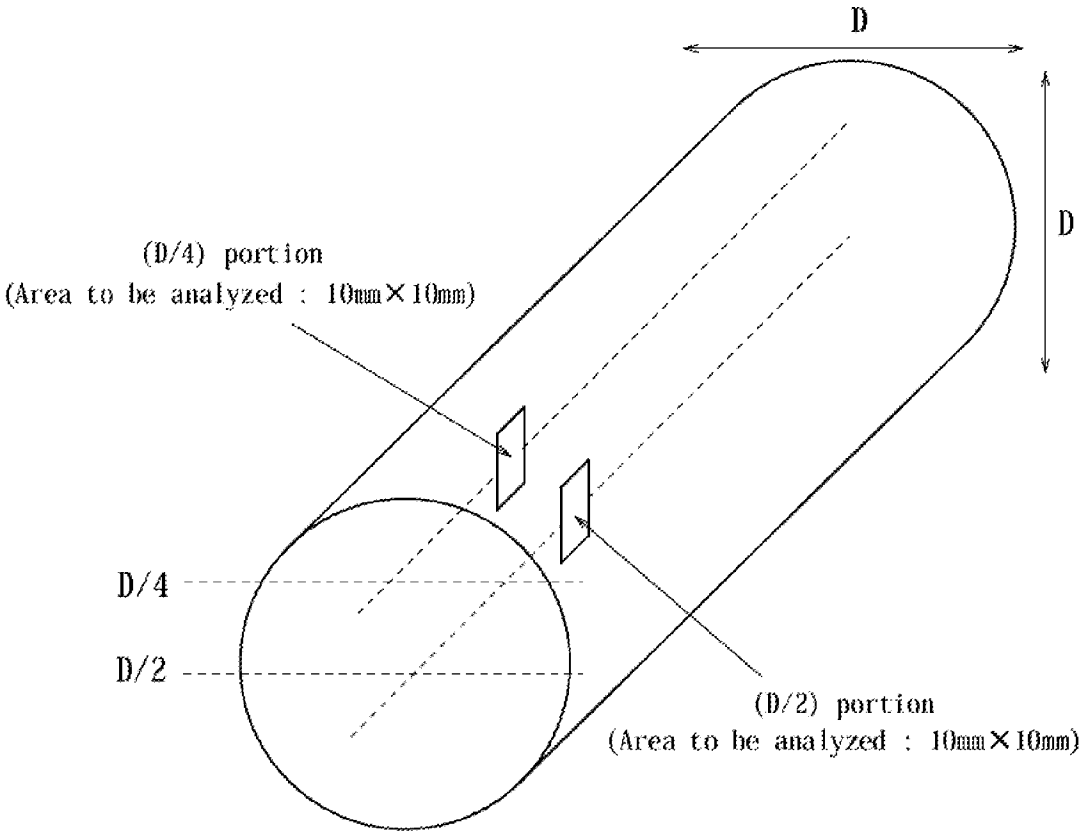
FIG. 4 is a view showing sample-collecting position and size of a surface to be analyzed when a test specimen for microstructure observation is to be collected from a steel billet having been subjected to circular forging.
Figure 8:
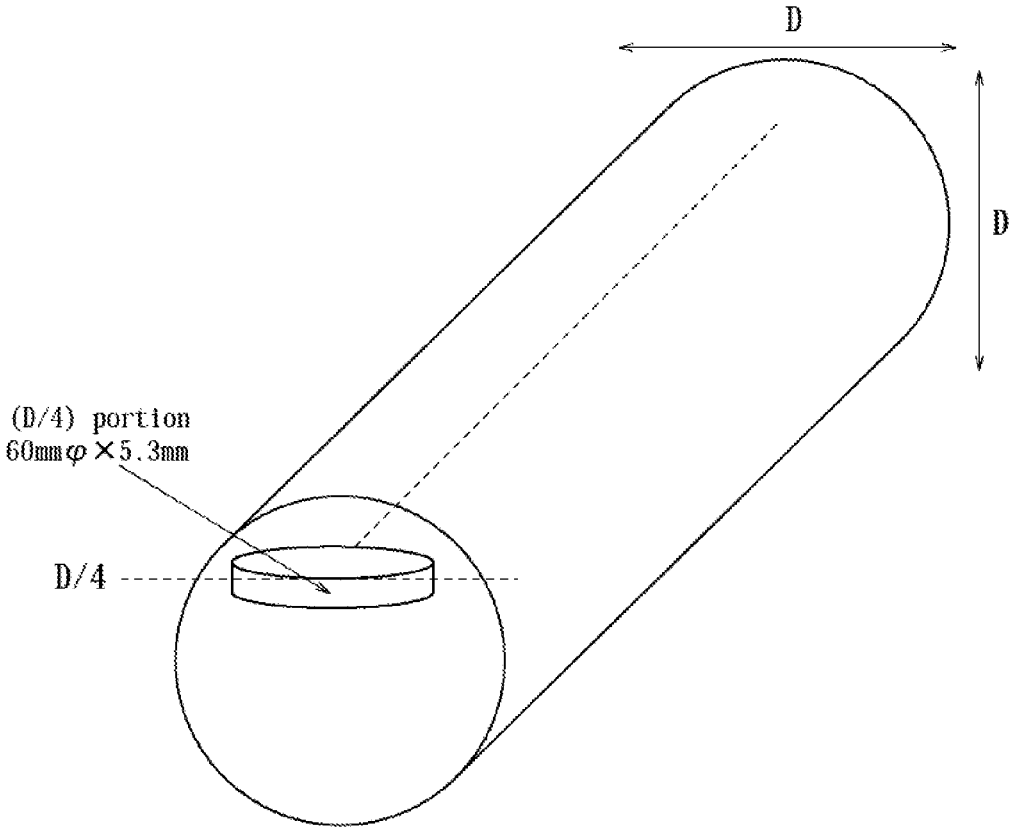
FIG. 8 is a view showing sample-collecting position and size of a test specimen when the test specimen for evaluating rolling contact fatigue life characteristics is to be collected from a steel billet having been subjected to circular forging.
Figure 10:
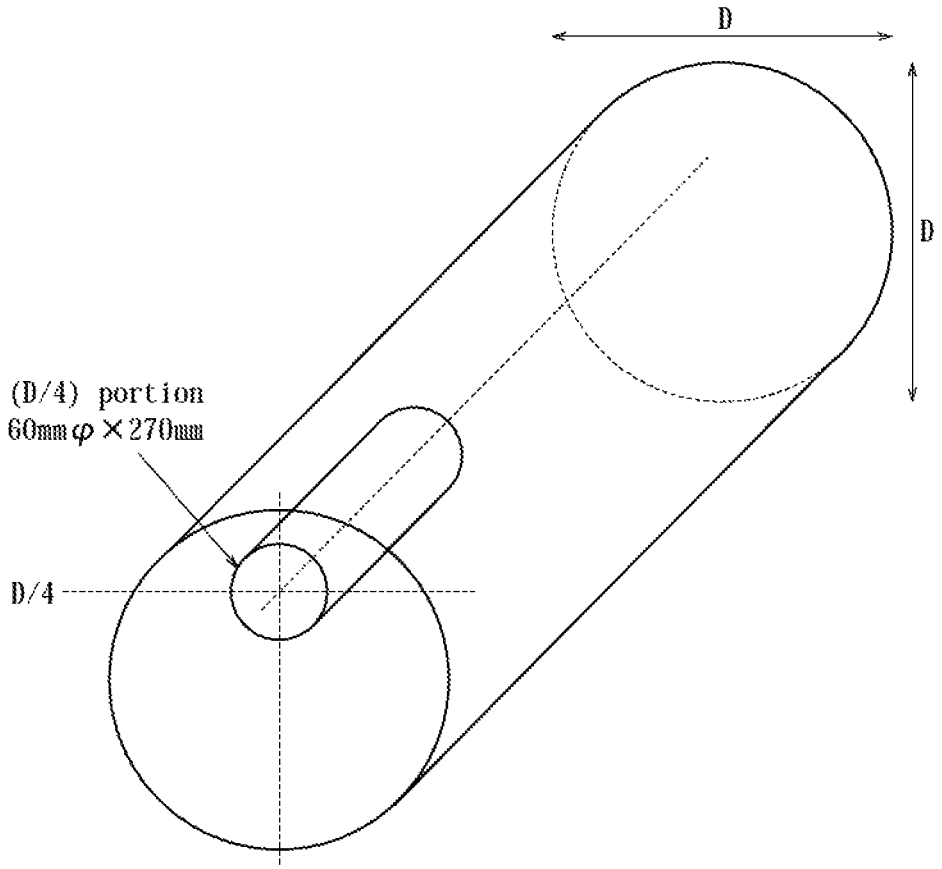
FIG. 10 is a view showing sample-collecting position and size of a test specimen when the test specimen for evaluating machinability by cutting is to be collected from a steel billet having been subjected to circular forging.

Presence/absence of eutectic carbide, degree of segregation, rolling contact fatigue life characteristics, and machinability by cutting of each of the billet samples thus prepared were investigated in the same manner as in Example 1. The respective specimen-collecting positions in the billet having square cross section were the same as those in Example 1. Regarding the billet having circular cross section, test specimens for microstructure observation were collected from a specimen-collecting position corresponding to D/4 and a specimen-collecting position corresponding to D/2 ("D" represents diameter of the billet. See FIG. 4) of the billet, respectively, such that surfaces to be observed of the specimens correspond to a cross section in the extension direction of the billet. A test specimen for the thrust type rolling contact fatigue test was collected from a specimen-collecting position corresponding to D/4 ("D" represents diameter of the billet. See FIG. 8) of the billet. A test specimen for evaluation of merchantability by cutting was collected from a specimen-collecting position corresponding to D/4 ("D" represents diameter of the billet subjected to circular forging. See FIG. 10) of the billet.

TABLE 8

(mass %)

| Steel sample ID | C | Si | Mn | P | S | Cr | Al | Mo | O | N | Cu |
|---|---|---|---|---|---|---|---|---|---|---|---|
| A-1 | 1.05 | 0.25 | 0.45 | 0.016 | 0.008 | 1.45 | 0.025 | 0.07 | 0.0010 | 0.0031 | — |
| D-1 | 0.63 | 0.32 | 0.99 | 0.011 | 0.005 | 0.88 | 0.021 | 0.33 | 0.0010 | 0.0033 | 0.01 |
| D-2 | 0.62 | 0.27 | 0.85 | 0.012 | 0.004 | 0.78 | 0.025 | 0.25 | 0.0008 | 0.0035 | — |
| D-3 | 0.65 | 0.45 | 1.44 | 0.015 | 0.007 | 0.53 | 0.490 | 0.21 | 0.0011 | 0.0041 | — |
| D-4 | 0.56 | 0.42 | 0.99 | 0.013 | 0.004 | 0.51 | 0.005 | 0.49 | 0.0009 | 0.0033 | 0.24 |
| D-5 | 0.67 | 0.16 | 0.62 | 0.010 | 0.005 | 0.94 | 0.032 | 0.15 | 0.0010 | 0.0045 | — |
| D-6 | 0.61 | 0.45 | 1.42 | 0.009 | 0.007 | 0.99 | 0.021 | 0.22 | 0.0010 | 0.0042 | — |
| D-7 | 0.70 | 0.49 | 1.53 | 0.011 | 0.004 | 0.51 | 0.111 | 0.18 | 0.0009 | 0.0087 | — |
| D-8 | 0.62 | 0.21 | 0.99 | 0.013 | 0.004 | 0.94 | 0.031 | 0.11 | 0.0013 | 0.0042 | 0.21 |
| D-9 | 0.47 | 0.45 | 1.48 | 0.015 | 0.004 | 0.51 | 0.055 | 0.12 | 0.0011 | 0.0049 | — |
| D-10 | 0.92 | 0.22 | 0.77 | 0.012 | 0.005 | 0.52 | 0.033 | 0.12 | 0.0009 | 0.0044 | — |
| D-11 | 0.62 | 0.70 | 0.92 | 0.011 | 0.004 | 0.72 | 0.032 | 0.12 | 0.0012 | 0.0062 | 0.18 |
| D-12 | 0.68 | 0.49 | 1.49 | 0.013 | 0.006 | 0.51 | 0.211 | 0.07 | 0.0010 | 0.0045 | — |
| D-13 | 0.64 | 0.24 | 1.21 | 0.015 | 0.006 | 0.81 | 0.050 | 0.59 | 0.0006 | 0.0081 | — |
| D-14 | 0.70 | 0.32 | 0.97 | 0.007 | 0.008 | 0.51 | 0.005 | 0.23 | 0.0005 | 0.0055 | — |
| D-15 | 0.63 | 0.22 | 0.61 | 0.012 | 0.009 | 0.92 | 0.035 | 0.22 | 0.0007 | 0.0041 | — |
| D-16 | 0.62 | 0.49 | 1.15 | 0.008 | 0.007 | 0.55 | 0.005 | 0.26 | 0.0008 | 0.0062 | — |
| D-17 | 0.56 | 0.16 | 1.07 | 0.014 | 0.006 | 1.10 | 0.080 | 0.25 | 0.0010 | 0.0059 | — |
| D-18 | 0.56 | 0.17 | 0.73 | 0.013 | 0.005 | 0.73 | 0.010 | 0.18 | 0.0008 | 0.0030 | 0.01 |
| D-19 | 0.64 | 0.26 | 0.88 | 0.010 | 0.006 | 0.82 | 0.530 | 0.17 | 0.0007 | 0.0045 | 0.01 |
| D-20 | 0.67 | 0.38 | 0.92 | 0.009 | 0.002 | 1.20 | 0.025 | 0.26 | 0.0009 | 0.0035 | — |
| D-21 | 0.66 | 0.35 | 0.90 | 0.008 | 0.001 | 0.40 | 0.033 | 0.27 | 0.0009 | 0.0036 | — |
| D-22 | 0.80 | 0.26 | 0.91 | 0.008 | 0.002 | 0.95 | 0.027 | 0.25 | 0.0008 | 0.0041 | — |
| D-23 | 0.60 | 0.25 | 0.79 | 0.008 | 0.001 | 0.85 | 0.027 | 0.26 | 0.0009 | 0.0020 | — |
| D-24 | 0.62 | 0.26 | 0.81 | 0.009 | 0.002 | 0.88 | 0.029 | 0.25 | 0.0010 | 0.0160 | — |

| Steel Sample ID | Ni | W | Nb | Ti | Zr | V | B | Ec | Note |
|---|---|---|---|---|---|---|---|---|---|
| A-1 | — | — | — | — | — | — | — | −0.24 | Reference steel |
| D-1 | 0.01 | — | — | — | — | — | — | 0.14 | Example steel |
| D-2 | — | — | — | — | — | — | — | 0.15 | Example steel |
| D-3 | — | — | — | — | — | — | — | −0.09 | Comp. Ex. steel |
| D-4 | 0.75 | — | 0.012 | — | — | — | — | 0.19 | Example steel |

TABLE 8-continued (mass %)

| | | | | | | | | | |
|---|---|---|---|---|---|---|---|---|---|
| D-5 | — | — | — | — | — | — | 0.0012 | 0.12 | Example steel |
| D-6 | — | — | — | — | — | — | — | 0.14 | Example steel |
| D-7 | — | — | — | 0.002 | — | 0.110 | — | −0.01 | Comp. Ex. steel |
| D-8 | 0.11 | — | — | — | 0.003 | — | — | 0.15 | Example steel |
| D-9 | — | — | — | — | — | — | — | 0.24 | Comp. Ex. steel |
| D-10 | — | — | — | — | — | — | — | −0.16 | Comp. Ex. steel |
| D-11 | 0.09 | — | — | — | — | — | — | 0.11 | Comp. Ex. steel |
| D-12 | — | 0.53 | — | — | — | — | — | −0.02 | Comp. Ex. steel |
| D-13 | — | — | — | — | — | — | — | 0.11 | Comp. Ex. steel |
| D-14 | — | — | 0.045 | — | — | — | — | 0.06 | Example steel |
| D-15 | — | 0.35 | — | — | — | — | — | 0.15 | Example steel |
| D-16 | — | — | — | — | — | — | — | 0.12 | Example steel |
| D-17 | — | — | — | — | — | — | — | 0.20 | Example steel |
| D-18 | 0.02 | — | — | — | — | — | — | 0.22 | Example steel |
| D-19 | 0.02 | — | — | — | — | — | — | −0.05 | Comp. Ex. steel |
| D-20 | — | — | — | — | — | — | — | 0.10 | Comp. Ex. steel |
| D-21 | — | — | — | — | — | — | — | 0.08 | Comp. Ex. steel |
| D-22 | — | — | — | — | — | — | — | −0.03 | Comp. Ex. steel |
| D-23 | — | — | — | — | — | — | — | 0.17 | Comp. Ex. steel |
| D-24 | — | — | — | — | — | — | — | 0.15 | Comp. Ex. steel |

"Example steel" represents steel according to the present invention.
"Comp. Ex. Steel" represents steel out of the scope of the present invention.

TABLE 9

| | Cross sectional dimensions after casting (mm) | | Cross sectional dimensions after forging (mm) | | |
|---|---|---|---|---|---|
| Steel sample ID | Top side | Bottom side | Cross sectional configuration※ | Cross sectional dimension | Note |
| A-1 | 1350 × 1250 | 1280 × 830 | □ | 550 | Reference steel |
| D-1 | 1330 × 1230 | 1280 × 860 | □ | 700 | Example steel |
| D-2 | 1330 × 1230 | 1280 × 860 | □ | 650 | Example steel |
| D-3 | 1000 × 1000 | 700 × 700 | ○ | 550 | Comp. Ex. steel |
| D-4 | 1250 × 1150 | 1180 × 730 | ○ | 700 | Example steel |
| D-5 | 1450 × 1350 | 1380 × 930 | □ | 650 | Example steel |
| D-6 | 1450 × 1350 | 1380 × 930 | ○ | 450 | Example steel |
| D-7 | 1330 × 1230 | 1280 × 860 | □ | 600 | Comp. Ex. steel |
| D-8 | 1330 × 1230 | 1280 × 860 | □ | 700 | Example steel |
| D-9 | 1100 × 1100 | 860 × 860 | □ | 450 | Comp. Ex. steel |
| D-10 | 1450 × 1350 | 1380 × 930 | □ | 750 | Comp. Ex. steel |
| D-11 | 1450 × 1350 | 1380 × 930 | ○ | 750 | Comp. Ex. steel |
| D-12 | 900 × 900 | 700 × 700 | ○ | 450 | Comp. Ex. steel |
| D-13 | 1330 × 1230 | 1280 × 860 | ○ | 800 | Comp. Ex. steel |
| D-14 | 1330 × 1230 | 1280 × 860 | □ | 750 | Example steel |
| D-15 | 1450 × 1350 | 1380 × 930 | ○ | 600 | Example steel |
| D-16 | 1100 × 1100 | 860 × 860 | □ | 450 | Example steel |
| D-17 | 1250 × 1150 | 1180 × 730 | ○ | 500 | Example steel |
| D-18 | 1100 × 1100 | 860 × 860 | ○ | 400 | Example steel |
| D-19 | 1250 × 1150 | 1180 × 730 | □ | 550 | Comp. Ex. steel |
| D-20 | 1330 × 1230 | 1280 × 860 | □ | 600 | Comp. Ex. steel |
| D-21 | 1330 × 1230 | 1280 × 860 | □ | 600 | Comp. Ex. steel |
| D-22 | 1330 × 1230 | 1280 × 860 | □ | 650 | Comp. Ex. steel |
| D-23 | 1330 × 1230 | 1280 × 860 | □ | 550 | Comp. Ex. steel |
| D-24 | 1330 × 1230 | 1280 × 860 | □ | 600 | Comp. Ex. steel |

※○ represents circular forging and □ represents square forging.
"Example steel" represents steelaccording to the present invention.
"Comp. Ex. Steel" repersents steel out of the scope of the present invention.

The results of presence/absence of eutectic carbide, degree of segregation, and the rolling contact fatigue life characteristics test are shown in Table 10. It is understood from these results that steel samples D-1, D-2, D-4 to D-6, D-8, and D-14 to D-18 each satisfying the chemical composition, the Ec value and the degree of segregation $C_{Mo(max)}/C_{Mo(ave)}$ within the scope of the present invention unanimously exhibit no presence of eutectic carbide in steel, the degrees of segregation within the range specified in the present invention, and satisfactorily good rolling contact fatigue life characteristics. In contrast, steel samples D-3, D-7 and D-12, each having the chemical composition within the scope of the present invention but of which Ec values fail to be within the scope of the present invention, exhibit presence of eutectic carbide in steel and thus poor rolling contact fatigue life characteristics, respectively. Further, steel samples D-9 to D-11, D-13, and D-19 to D-24, of which chemical compositions fail to be within the scope of the present invention, unanimously exhibit poor rolling contact fatigue life characteristics. Steel sample D-20, having the Ec value within the scope of the present invention but of which Cr content is out of the scope of the present invention, exhibits poor machinability of cutting.

$$Ec=(-0.07\times[\%\ Si]-0.03\times[\%\ Mn]+0.04\times[\%\ Cr]-0.36\times[\%\ Al]+0.79)-[\%\ C] \quad (1)$$

$$\text{Degree of segregation}=C_{Mo(max)}/C_{Mo(ave)} \quad (2)$$

TABLE 10

| Test results | | | | | |
|---|---|---|---|---|---|
| Steel sample ID | Presence/absence of eutectic carbide | $C_{Mo(max)}/C_{Mo(ave)}$ | Rolling contact fatigue life ($B_{10}$ life ratio) | Tool life ratio | Note |
| A-1 | Presence | 1.8 | 1.00 | 1.00 | Reference steel |
| D-1 | Absence | 2.5 | 1.41 | 1.21 | Example steel |
| D-2 | Absence | 2.1 | 1.43 | 1.20 | Example steel |
| D-3 | Presence | 2.1 | 1.07 | 1.18 | Comp. Ex. steel |
| D-4 | Absence | 2.6 | 1.41 | 1.22 | Example steel |
| D-5 | Absence | 1.8 | 1.40 | 1.22 | Example steel |
| D-6 | Absence | 2.1 | 1.41 | 1.21 | Example steel |
| D-7 | Presence | 1.9 | 1.07 | 1.17 | Comp. Ex. steel |
| D-8 | Absence | 1.5 | 1.39 | 1.23 | Example steel |
| D-9 | Absence | 1.4 | 1.08 | 1.25 | Comp. Ex. steel |
| D-10 | Presence | 1.5 | 1.05 | 1.12 | Comp. Ex. steel |
| D-11 | Absence | 1.5 | 1.06 | 1.19 | Comp. Ex. steel |
| D-12 | Presence | 1.4 | 1.05 | 1.21 | Comp. Ex. steel |
| D-13 | Absence | 3.1 | 1.06 | 1.21 | Comp. Ex. steel |
| D-14 | Absence | 2.1 | 1.39 | 1.20 | Example steel |
| D-15 | Absence | 2.1 | 1.40 | 1.23 | Example steel |
| D-16 | Absence | 2.3 | 1.39 | 1.21 | Example steel |
| D-17 | Absence | 2.3 | 1.39 | 1.18 | Example steel |
| D-18 | Absence | 1.9 | 1.40 | 1.18 | Example steel |
| D-19 | Presence | 1.9 | 1.05 | 1.13 | Comp. Ex. steel |
| D-20 | Absence | 2.9 | 1.15 | 1.12 | Comp. Ex. steel |
| D-21 | Absence | 2.4 | 1.08 | 1.21 | Comp. Ex. steel |
| D-22 | Presence | 2.9 | 1.07 | 1.16 | Comp. Ex. steel |
| D-23 | Absence | 2.3 | 1.08 | 1.22 | Comp. Ex. steel |
| D-24 | Absence | 2.2 | 1.07 | 1.19 | Comp. Ex. steel |

"Example steel" represents steel according to the present invention.
"Comp. Ex. Steel" represents steel out of the scope of the invention.

INDUSTRIAL APPLICABILITY

According to the present invention, it is possible to inexpensively manufacture bearing steel having excellent rolling contact fatigue life characteristics by ingot casting, thereby successfully providing very valuable bearing steel in industrial terms.

The invention claimed is:

1. Bearing steel, comprising a chemical composition including by mass %,

C: 0.56% to 0.70%, inclusive of 0.56% and 0.70%,

Si: 0.15% to 0.50%, inclusive of 0.15% and exclusive of 0.50%,

Mn: 0.60% to 1.50%, inclusive of 0.60% and 1.50%,

Cr: 0.50% to 1.10%, inclusive of 0.50% and 1.10%,

Mo: 0.05% to 0.5%, inclusive of 0.05% and 0.5%,

P: 0.025% or less,

S: 0.025% or less,

Al: 0.005% to 0.500%, inclusive of 0.005% and 0.500%,

O: 0.0015% or less,

N: 0.0030% to 0.015%, inclusive of 0.0030% and 0.015%, and remainder as Fe and incidental impurities, wherein "eutectic carbide formation index Ec" represented by following formula (1) is in the range of 0.04=<Ec≤0.23 and "degree of segregation" represented by following formula (2) is equal to or less than 2.8 in the bearing steel, in formulae (1) and (2), "[% M]" represents content (mass %) of component M and $C_{Mo(max)}$ represents the maximum value of Mo intensity value and $C_{Mo(ave)}$ represents the average value of Mo intensity value.

2. The bearing steel of claim 1, wherein the chemical composition further includes at least one group selected from (A) to (C), wherein (A) by mass % at least one element selected from:

Cu: 0.005% to 0.5%, inclusive of 0.005% and 0.5%, and

Ni: 0.005% to 1.00%, inclusive of 0.005% and 1.00%, (B) by mass % at least one element selected from:

W: 0.001% to 0.5%, inclusive of 0.001% and 0.5%,

Nb: 0.001% to 0.1%, inclusive of 0.001% and 0.1%,

Ti: 0.001% to 0.1%, inclusive of 0.001% and 0.1%,

Zr: 0.001% to 0.1%, inclusive of 0.001% and 0.1%, and

V: 0.002% to 0.5%, inclusive of 0.002% and 0.5%, and (C) by mass %

B: 0.0002% to 0.005%, inclusive of 0.0002% and 0.005%.

3. A method for manufacturing bearing steel, comprising:

preparing a bearing steel material of claim 1; and heating the bearing steel material at temperature in the range of 1150° C. to 1350° C., inclusive of 1150° C. and exclusive of 1350° C. for a period exceeding 10 hours.

4. An ingot material for a bearing, comprising a chemical composition including by mass %, C: 0.56% to 0.70%, inclusive of 0.56% and 0.70%, Si: 0.15% to 0.50%, inclusive of 0.15% and exclusive of 0.50%, Mn: 0.60% to 1.50%, inclusive of 0.60% and 1.50%, Cr: 0.50% to 1.10%, inclusive of 0.50% and 1.10%, Mo: 0.05% to 0.5%, inclusive of 0.05% and 0.5%, P: 0.025% or less, S: 0.025% or less, Al: 0.005% to 0.500%, inclusive of 0.005% and 0.500%, O: 0.0015% or less, N: 0.0030% to 0.015%, inclusive of 0.0030% and 0.015%, and remainder as Fe and incidental impurities, wherein "eutectic carbide formation index Ec" represented by following formula (1) is in the range of 0.04=<Ec≤0.23 and "degree of segregation" represented by following formula (2) is equal to or less than 2.8 in the bearing steel, $$Ec=(-0.07\times[\%\ Si]-0.03\times[\%\ Mn]+0.04\times[\%\ Cr]-0.36\times[\%\ Al]+0.79)-[\%\ C] \quad (1)$$

$$\text{Degree of segregation}=C_{Mo(max)}/C_{Mo(ave)} \quad (2)$$

in formulae (1) and (2), "[% M]" represents content (mass %) of component M and $C_{Mo(max)}$ represents the maximum value of Mo intensity value and $C_{Mo(ave)}$ represents the average value of Mo intensity value.

5. The ingot material for a bearing of claim 4, wherein the chemical composition further includes at least one group selected from (A) to (C), wherein (A) by mass % at least one element selected from:
Cu: 0.005% to 0.5%, inclusive of 0.005% and 0.5%, and
Ni: 0.005% to 1.00%, inclusive of 0.005% and 1.00%, (B) by mass % at least one element selected from:
W: 0.001% to 0.5%, inclusive of 0.001% and 0.5%,
Nb: 0.001% to 0.1%, inclusive of 0.001% and 0.1%,
Ti: 0.001% to 0.1%, inclusive of 0.001% and 0.1%,
Zr: 0.001% to 0.1%, inclusive of 0.001% and 0.1%, and
V: 0.002% to 0.5%, inclusive of 0.002% and 0.5%, and (C) by mass %
B: 0.0002% to 0.005%, inclusive of 0.0002% and 0.005%.

6. A method for manufacturing an ingot material for a bearing, comprising:

preparing a pre-finished ingot material for a bearing of claim 4; and heating the pre-finished bearing steel material at temperature in the range of 1150° C. to 1350° C., inclusive of 1150° C. and exclusive of 1350° C. for a period exceeding 10 hours.

7. A method for manufacturing bearing steel, comprising:

preparing a bearing steel material of claim 2; and heating the bearing steel material at temperature in the range of 1150° C. to 1350° C., inclusive of 1150° C. and exclusive of 1350° C. for a period exceeding 10 hours.

8. A method for manufacturing an ingot material for a bearing, comprising:

preparing a pre-finished ingot material for a bearing of claim 5; and heating the pre-finished bearing steel material at temperature in the range of 1150° C. to 1350° C., inclusive of 1150° C. and exclusive of 1350° C. for a period exceeding 10 hours.

* * * * *